US009511378B2

(12) United States Patent
Hines et al.

(10) Patent No.: US 9,511,378 B2
(45) Date of Patent: Dec. 6, 2016

(54) COLLECTOR COMPOSITIONS AND METHODS FOR MAKING AND USING SAME

(71) Applicant: Georgia-Pacific Chemicals LLC, Atlanta, GA (US)

(72) Inventors: John B. Hines, Atlanta, GA (US); Brian L. Swift, Oxford, GA (US)

(73) Assignee: Georgia-Pacific Chemicals LLC, Atlanta, GA (US)

( * ) Notice: Subject to any disclaimer, the term of this patent is extended or adjusted under 35 U.S.C. 154(b) by 35 days.

(21) Appl. No.: 14/509,086

(22) Filed: Oct. 8, 2014

(65) Prior Publication Data

US 2015/0096925 A1 Apr. 9, 2015

Related U.S. Application Data

(60) Provisional application No. 61/888,571, filed on Oct. 9, 2013.

(51) Int. Cl.
*B03D 1/01* (2006.01)
*B03D 1/02* (2006.01)

(52) U.S. Cl.
CPC ..... *B03D 1/01* (2013.01); *B03D 1/021* (2013.01); *B03D 2201/02* (2013.01); *B03D 2201/04* (2013.01); *B03D 2203/006* (2013.01); *B03D 2203/02* (2013.01); *B03D 2203/06* (2013.01); *B03D 2203/08* (2013.01)

(58) Field of Classification Search
CPC ..... B03D 1/01; B03D 1/02
See application file for complete search history.

(56) References Cited

U.S. PATENT DOCUMENTS

| | | | | |
|---|---|---|---|---|
| 2,293,470 | A * | 8/1942 | Mead | B03D 1/021 209/166 |
| 2,312,387 | A * | 3/1943 | Christmann | B03D 1/01 209/166 |
| 5,562,898 | A * | 10/1996 | Dowell | A61K 8/19 424/70.1 |
| 8,133,970 | B2 | 3/2012 | Hurd et al. | |
| 8,425,781 | B2 | 4/2013 | Hines et al. | |
| 2014/0048454 | A1* | 2/2014 | Birken | B03D 1/01 209/166 |

FOREIGN PATENT DOCUMENTS

| | | | |
|---|---|---|---|
| WO | 87-03221 | A1 | 6/1987 |
| WO | 2012-139939 | A1 | 10/2012 |

OTHER PUBLICATIONS

Baldino, Rogerio de Oliveira et al., "Influence of Temperature, Water Quality and Collector Type on Flotation Performance of a Peruvian Phosphate Ore," Journal of Chemistry and Chemical Engineering, Apr. 25, 2013, vol. 7, No. 4, pp. 351-355.
International Search Report and Written Opinion for International Application No. PCT/US2014/059685 mailed Jan. 22, 2015.

* cited by examiner

*Primary Examiner* — Carol M Koslow
(74) *Attorney, Agent, or Firm* — Ram W. Sabnis

(57) ABSTRACT

Collector compositions and methods for making and using same to purify one or more crude materials are provided. The collector composition can include one or more amidoamines having the chemical Formula I and one or more amines having the chemical Formula IV, where a weight ratio of the amidoamine to the amine can be about 99:1 to about 1:99.

21 Claims, No Drawings

COLLECTOR COMPOSITIONS AND METHODS FOR MAKING AND USING SAME

CROSS-REFERENCE TO RELATED APPLICATION

This application claims priority to U.S. Provisional Patent Application having Ser. No. 61/888,571, filed on Oct. 9, 2013, which is incorporated by reference herein.

BACKGROUND

Field

Embodiments described herein generally relate to collector compositions and methods for making and using same to purify one or more crude materials. More particularly, such embodiments relate to collector compositions that can include one or more amidoamines and one or more amines.

Description of the Related Art

Froth flotation is a physiochemical mineral concentration method that uses the natural and created differences in the hydrophobicity of the minerals to be separated from aqueous slurries. To enhance an existing or to create new water repellencies on the surface of the minerals, certain heteropolar or nonpolar chemicals called collectors are added to an aqueous slurry containing the minerals to be separated or purified. These collectors are designed to selectively attach to one or more of the minerals to be separated, forming a hydrophobic monolayer on their surfaces. The formation of the hydrophobic monolayer makes the minerals more likely to attach to air bubbles upon collision. The mass of the combined air bubble/mineral particles is less dense than the displaced mass of the aqueous slurry, which causes the air bubble/mineral particles to float to the surface where they form a mineral-rich froth that can be skimmed off from the flotation unit, while the other minerals remain submerged in the pulp. The flotation of minerals with a negative surface charge, such as silica, silicates, feldspar, mica, clays, chrysocola, potash and others, from an aqueous slurry can be achieved using cationic collectors.

In reverse flotation, impurities are floated out of and away from the unpurified or crude materials to be beneficiated or otherwise purified. In particular, phosphate minerals, iron ore, copper ores, calcium carbonate, feldspar, and other minerals and/or ores are frequently beneficiated by reverse flotation. In many cases, minerals containing silicate are the main components of these impurities which cause quality reductions in the end product. The minerals containing silicate include quartz, mica, feldspar, muscovite, and biotite. A high silicate content lowers the quality of iron ore concentrate, which can be purified via flotation using collectors so that high-grade steels can be produced from the low-silicate concentrate. Conventional collectors for silicate flotation, however, exhibit inadequate results with respect to selectivity and yield.

There is a need, therefore, for improved collector compositions and methods for making and using same in flotation processes.

SUMMARY

Collector compositions and methods for making and using the same are provided. In at least one specific embodiment, the collector composition can include one or more amidoamines and one or more amines. The one or more amidoamines can have the chemical formula:

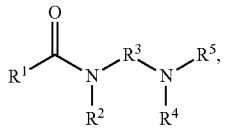

where $R^1$ can be a $(C_1\text{-}C_{24})$alkyl, a $(C_1\text{-}C_{24})$alkenyl, a $(C_1\text{-}C_{24})$dialkenyl, a $(C_1\text{-}C_{24})$cycloalkyl, a $(C_1\text{-}C_{24})$cylcoalkenyl, a $(C_1\text{-}C_{24})$cyclodialkenyl, a phenyl, a benzyl, an unsubstituted aryl, or an aryl substituted by one or more substituents selected from a halogen, a $(C_1\text{-}C_6)$alkyl, and a halogen-$(C_1\text{-}C_6)$alkyl; $R^2$ can be a hydrogen, a $(C_1\text{-}C_6)$alkyl, a halogen-$(C_1\text{-}C_6)$alkyl, a $(C_1\text{-}C_6)$alkenyl, a heterocyclyl, an unsubstituted aryl, or an aryl substituted by one or more substituents selected from a halogen, a $(C_1\text{-}C_6)$alkyl, and a halogen-$(C_1\text{-}C_6)$alkyl; $R^3$ can be a $(C_1\text{-}C_{24})$alkylene, a $(C_1\text{-}C_{24})$alkenylene, a $(C_1\text{-}C_{24})$dialkenylene, a $(C_1\text{-}C_{24})$cycloalkylene, a $(C_1\text{-}C_{24})$cylcoalkenylene, or a $(C_1\text{-}C_{24})$cyclodialkenylene; and $R^4$ and $R^5$ can independently be selected from a hydrogen, a $(C_1\text{-}C_{24})$alkyl, a $(C_1\text{-}C_{24})$alkenyl, a $(C_1\text{-}C_{24})$dialkenyl, a $(C_1\text{-}C_{24})$cycloalkyl, a $(C_1\text{-}C_{24})$cylcoalkenyl, and a $(C_1\text{-}C_{24})$cyclodialkenyl. The one or more amines can have the chemical formula:

$$R^6\text{—}NH_2,$$

where $R^6$ can be a $(C_1\text{-}C_{24})$alkyl, a phenyl, a benzyl, a $(C_1\text{-}C_{24})$alkenyl, a heterocyclyl, an unsubstituted aryl, or an aryl substituted by one or more $(C_1\text{-}C_8)$alkyl substituents. A weight ratio of the amidoamine to the amine can be about 99:1 to about 1:99.

In at least one specific embodiment, a method for froth flotation can include contacting an aqueous slurry that includes a crude material having one or more purifiable materials with a collector composition to provide a treated mixture. The amidoamine can have the chemical formula:

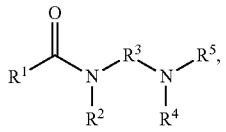

where $R^1$ can be a $(C_1\text{-}C_{24})$alkyl, a $(C_1\text{-}C_{24})$alkenyl, a $(C_1\text{-}C_{24})$dialkenyl, a $(C_1\text{-}C_{24})$cycloalkyl, a $(C_1\text{-}C_{24})$cylcoalkenyl, a $(C_1\text{-}C_{24})$cyclodialkenyl, a phenyl, a benzyl, an unsubstituted aryl, or an aryl substituted by one or more substituents selected from a halogen, a $(C_1\text{-}C_6)$alkyl, and a halogen-$(C_1\text{-}C_6)$alkyl; $R^2$ can be a hydrogen, a $(C_1\text{-}C_6)$alkyl, a halogen-$(C_1\text{-}C_6)$alkyl, a $(C_1\text{-}C_6)$alkenyl, a heterocyclyl, an unsubstituted aryl, or an aryl substituted by one or more substituents selected from a halogen, a $(C_1\text{-}C_6)$alkyl, and a halogen-$(C_1\text{-}C_6)$alkyl; $R^3$ can be a $(C_1\text{-}C_{24})$alkylene, a $(C_1\text{-}C_{24})$alkenylene, a $(C_1\text{-}C_{24})$dialkenylene, a $(C_1\text{-}C_{24})$cycloalkylene, a $(C_1\text{-}C_{24})$cylcoalkenylene, or a $(C_1\text{-}C_{24})$cyclodialkenylene; and $R^4$ and $R^5$ can independently be selected from a hydrogen, a $(C_1\text{-}C_{24})$alkyl, a $(C_1\text{-}C_{24})$alkenyl, a $(C_1\text{-}C_{24})$dialkenyl, a $(C_1\text{-}C_{24})$cycloalkyl, a $(C_1\text{-}C_{24})$cylcoalkenyl, and a $(C_1\text{-}C_{24})$cyclodialkenyl. The amine can have the chemical formula:

$$R^6\text{—}NH_2,$$

where $R^6$ can be a $(C_1\text{-}C_{24})$alkyl, a phenyl, a benzyl, a $(C_1\text{-}C_{24})$alkenyl, a heterocyclyl, an unsubstituted aryl, or an aryl substituted by one or more $(C_1\text{-}C_8)$alkyl substituents. A weight ratio of the amidoamine to the amine can be about 99:1 to about 1:99. The method can also include purifying, recovering, or otherwise collecting the one or more purifiable materials from the treated mixture.

In at least one other specific embodiment, a method for froth flotation can include contacting an aqueous slurry that includes a crude material having one or more purifiable materials with a collector composition to provide a treated mixture. The collector composition can include one or more amidoamines having the chemical formula:

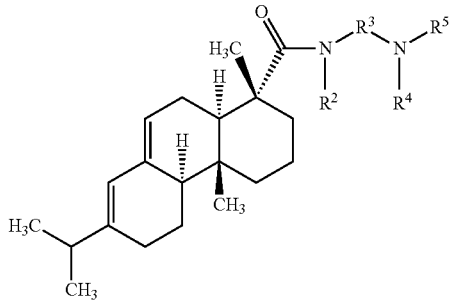

or the chemical formula:

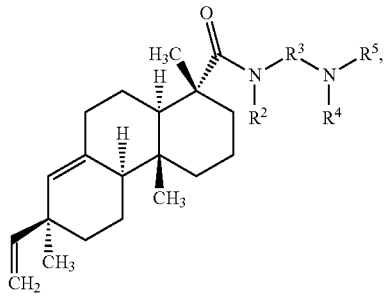

where $R^2$ can be a hydrogen, a $(C_1-C_6)$alkyl, a halogen-$(C_1-C_6)$alkyl, a $(C_1-C_6)$alkenyl, a heterocyclyl, an unsubstituted aryl, or an aryl substituted by one or more substituents selected from a halogen, a $(C_1-C_6)$alkyl, and a halogen-$(C_1-C_6)$alkyl; $R^3$ can be a $(C_1-C_{24})$alkylene, a $(C_1-C_{24})$alkenylene, a $(C_1-C_{24})$dialkenylene, a $(C_1-C_{24})$cycloalkylene, a $(C_1-C_{24})$cylcoalkenylene, or a $(C_1-C_{24})$cyclodialkenylene; and $R^4$ and $R^5$ can independently be selected from a hydrogen, a $(C_1-C_{24})$alkyl, a $(C_1-C_{24})$alkenyl, a $(C_1-C_{24})$dialkenyl, a $(C_1-C_{24})$cycloalkyl, a $(C_1-C_{24})$cylcoalkenyl, and a $(C_1-C_{24})$cyclodialkenyl. The collector composition can also include one or more amines having the chemical formula:

$$R^6—NH_2,$$

where $R^6$ can be a $(C_1-C_{24})$alkyl, a phenyl, a benzyl, a $(C_1-C_{24})$alkenyl, a heterocyclyl, an unsubstituted aryl, or an aryl substituted by one or more $(C_1-C_8)$alkyl substituents. A weight ratio of the amidoamine to the amine can be about 99:1 to about 1:99. The method can also include purifying, recovering, or otherwise collecting the one or more purifiable materials from the treated mixture.

DETAILED DESCRIPTION

It has been surprisingly and unexpectedly discovered that a collector composition containing a combination of one or more amidoamines and one or more amines can be used in a separation process, e.g., froth flotation, for the purification of ores containing silica or silicates to significantly increase the recovery or collection of enriched or purified ore as compared to using a collector that contains the amidoamine or the amine alone. The combination of the amine and the amidoamine provides good selectivity and high yield of the silicate in the float, while the bottom fraction contains the purifiable material in a high yield and low silicate content. For example, the collector containing both the amidoamine and the amine can increase the recovery or collection of purifiable material as compared to using a collector that contains only the amine alone in an amount from a low of about 0.2%, about 0.5%, about 1%, about 2%, about 3%, or about 4%, to a high of about 5%, about 6%, about 7%, about 8%, about 9%, about 10%, or more. In another example, the collector containing both the amidoamine and the amine can increase the recovery or collection of purifiable material as compared to using a collector that contains only the amine alone in an amount of about 0.2% to about 0.5%, about 0.5% to about 1%, about 1% to about 3%, about 2% to about 5%, or about 4% to about 10%. In another example, the collector containing both the amidoamine and the amine can increase the recovery or collection of a purifiable material as compared to using a collector that contains only the amidoamine alone in an amount from a low of about 0.2%, about 0.5%, about 1%, about 2%, about 3%, or about 4%, to a high of about 5%, about 6%, about 7%, about 8%, about 9%, about 10%, or more. In another example, the collector containing both the amidoamine and the amine can increase the recovery or collection of purifiable material as compared to using a collector that contains only the amidoamine alone in an amount of about 0.2% to about 0.5%, about 0.5% to about 1%, about 1% to about 3%, about 2% to about 5%, or about 4% to about 10%.

It has also been surprisingly and unexpectedly discovered that further adding one or more etheramines to the collector composition containing the one or more amidoamines and the one or more amines can also provide good selectivity and high yield. For example, the collector composition containing a mixture of the amidoamine, the amine, and the etheramine can increase the recovery or collection of purifiable material as compared to using a collector that contains only the amine alone in an amount of about 0.2% to about 0.5%, about 0.5% to about 1%, about 1% to about 3%, about 2% to about 5%, or about 4% to about 10%. In another example, the collector composition containing a mixture of the amidoamine, the amine, and the etheramine can increase the recovery or collection of purifiable material as compared to using a collector that contains only the amidoamine alone in an amount from a low of about 0.2%, about 0.5%, about 1%, about 2%, about 3%, or about 4%, to a high of about 5%, about 6%, about 7%, about 8%, about 9%, about 10%, or more. In another example, the collector composition containing a mixture of the amidoamine, the amine, and the etheramine can increase the recovery or collection of purifiable material as compared to using a collector that contains only the amidoamine alone in an amount of about 0.2% to about 0.5%, about 0.5% to about 1%, about 1% to about 3%, about 2% to about 5%, or about 4% to about 10%.

Suitable amidoamines can be represented by the following chemical Formula (I):

(I)

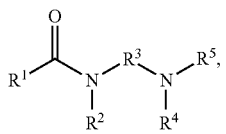

where $R^1$ can be a $(C_1-C_{24})$alkyl, a $(C_1-C_{24})$alkenyl, a $(C_1-C_{24})$dialkenyl, a $(C_1-C_{24})$cycloalkyl, a $(C_1-C_{24})$cylcoalkenyl, a $(C_1-C_{24})$cyclodialkenyl, a phenyl, a benzyl, an unsubstituted aryl, and an aryl substituted by one or more substituents selected from a halogen, a $(C_1-C_6)$alkyl, and a halogen-$(C_1-C_6)$alkyl; $R^2$ can be a hydrogen, a $(C_1-C_6)$ alkyls, a halogen-$(C_1-C_6)$alkyl, a $(C_1-C_6)$alkenyl, a heterocyclyl, an unsubstituted aryl, and an aryl substituted by one or more substituents selected from a halogen, a $(C_1-C_6)$ alkyl, and a halogen-$(C_1-C_6)$alkyl; $R^3$ can be a $(C_1-C_{24})$ alkylene, a $(C_1-C_{24})$alkenylene, a $(C_1-C_{24})$dialkenylene, a $(C_1-C_{24})$cycloalkylene, a $(C_1-C_{24})$cylcoalkenylene, a $(C_1-C_{24})$cyclodialkenylene; and $R^4$ and $R^5$ can independently be selected from a hydrogen, a $(C_1-C_{24})$alkyl, a $(C_1-C_{24})$alkenyl, a $(C_1-C_{24})$dialkenyl, a $(C_1-C_{24})$cycloalkyl, a $(C_1-C_{24})$ cylcoalkenyl, and a $(C_1-C_{24})$cyclodialkenyl.

In some embodiments, $R^2$ and $R^3$ can be joined or bonded to one another to form a $(C_4-C_{10})$alkylene link, with the link optionally incorporating 1 or 2 heteroatoms each independently selected from N, O, and S. Said another way, the $(C_4-C_{10})$alkylene link refers to a cyclic amino group that can also contain an oxygen atom and/or a sulfur atom. Illustrative examples of cyclic amino groups can include, but are not limited to, a pyrrolidino group, a piperidino group, a piperazino group, an N-methylpiperazino group, an N-phenylpiperazino group, a morpholino group, a thiomorpholino group, a hexamethyleneimino group, a 3,3,5-trimethylhexahydroazepino group, and the like. The cyclic amino group can also form a quaternary amine further substituted with a $(C_1-C_6)$alkyl group, a substituted $(C_1-C_6)$alkyl group, an aralkyl group or a substituted aralkyl group.

As depicted in Formula I, $R^4$ and $R^5$ are bonded to nitrogen and compose an amino group. The amino group can be a primary amino group, a secondary amino group, or a tertiary amino group. $R^4$ and $R^5$ can be joined or bonded to one another to form a $(C_4-C_{10})$alkylene link, with the link optionally incorporating 1 or 2 heteroatoms each independently selected from N, O, and S. Said another way, the $(C_4-C_{10})$alkylene link refers to a cyclic amino group that can contain a nitrogen atom, an oxygen atom, and/or a sulfur atom. Illustrative examples can include a methylamino group, a dimethylamino group, an ethylamino group, a diethylamino group, a methylethylamino group, a propylamino group, a dipropylamino group, an isopropylamino group, a diisopropylamino group, a butylamino group, a dibutylamino group and the like. The amino group substituted with two groups selected from $(C_1-C_6)$alkyl groups can be further substituted with a $(C_1-C_6)$alkyl group, a substituted $(C_1-C_6)$alkyl group, an aralkyl group or a substituted aralkyl group.

Illustrative examples of $(C_1-C_{24})$alkyls for $R^1$ can include, but are not limited to, branched and straight-chain monovalent saturated aliphatic hydrocarbon radicals containing one to twenty-four carbon atoms, e.g., methyl, ethyl, propyl, isopropyl, butyl, isobutyl, tert-butyl, the isomeric pentyls, the isomeric hexyls, octyl, nonyl, decyl, undecyl, dodecyl, tridecyl, tetra decyl, pentadecyl, hexadecyl, heptadecyl, octadecyl, nondecyl, eicosyl, henicosyl, docosyl, tricosyl. The branched-chain $(C_1-C_{24})$alkyls can include one or more branching sites along the longest carbon chain. The $(C_1-C_{24})$alkyls can include isomers branched at the terminal end of the longest carbon chain. For example, the $(C_1-C_{24})$alkyls can include iso- and neo-isomers. In another example, the branching can include the last five carbons on the longest carbon chain. The branched chain $(C_1-C_{24})$alkyls can also include branching with aryl groups, such as phenyl and benzyl. The branched-chains can be synthesized according to Ursula Biermann & Jürgen O. Metzger, Synthesis of Alkyl-Branched Fatty Acids, 110 Eur. J. Lipid Sci. Technol. 805, 805-811 (2008).

Illustrative examples of heterocyclyl groups for the substituents can include, but are not limited to, a heteroaryl group such as pyridinyl, pyridazinyl, pyrimidinyl, thiazolyl, oxazolyl, isothiazolyl, isoxazolyl, thiophenyl, furanyl, pyrazolyl, indolyl, benzo[b]thiophenyl, 4,5,6,7-tetrahydro-benzo[b]thiophenyl, benzofuranyl, 4,5,6,7-tetrahydro-benzothiazolyl, aminopyridinyl, aminopyridazinyl, aminopyrimidinyl, aminothiophenyl, aminopyrazolyl, aminothiazolyl, aminoisothiazolyl, aminoisoxazolyl, 2-aminopyridin-3-yl, 3-aminopyridin-2-yl, 4-aminopyridin-3-yl, 3-aminopyridin-4-yl, 3-amino-pyridazin-2-yl, 4-aminopyridazin-3-yl, 5-aminopyridazin-4-yl, 3-aminopyridazin-4-yl, 4-amino-pyrimidin-5-yl, 5-aminopyrimidin-4-yl, 5-aminothiazol-4-yl, 5-aminoisothiazol-4-yl and 3-aminoisoxazol-4-yl, 2-aminothiophen-3-yl, 3-aminothiophen-2-yl, 3-aminothiophen-4-yl, 5-aminopyrazol-4-yl. The heterocycle group can be unsubstituted or substituted by one to three substituents selected from halogen, alkyl, halogenalkyl, and cycloalkyl, which can again be unsubstituted or substituted by one or more of the above mentioned substituents.

The amidoamine can be synthesized by reacting one or more carboxylic acids and/or one or more carboxylic acid derivatives with a polyamine via a condensation reaction. An illustrative condensation reaction of a carboxylic acid and a polyamine can be as depicted in Reaction I.

(Reaction I)

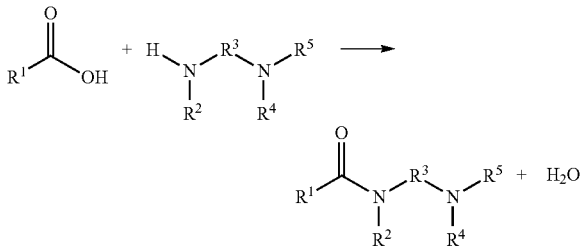

The carboxylic acid undergoes nucleophilic attack by the amine. The nucleophilic attack can take place through any of the polyamine's amino groups; however, the amino groups that have different neighboring groups will have different chemoselectivity with respect to the other amino groups. The reaction conditions can be used to favor the reaction at the terminal amine positions.

Suitable carboxylic acid derivatives can be represented by the following chemical Formula (II):

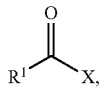

(II)

where R' can be as discussed and described above with respect to Formula I and X is OH. The carboxylic acid can be hydrolyzed to form a carboxylate salt where X is OLi, ONa, or OK. The carboxylic acid can be a carboxylic acid derivative, such as an acyl chloride where X is Cl. The carboxylic acid derivative can also be an ester where X is OR, and R is a $(C_1-C_6)$alkyl.

The carboxylic acid reactants can be or include a fatty acid, a mixture of fatty acids, a fatty acid ester, a mixture of fatty acid esters, or a mixture of one or more fatty acids and one or more fatty acid esters. Representative fatty acids include oleic acid, lauric acid, linoleic acid, linolenic acid, palmitic acid, stearic acid, ricinoleic acid, myristic acid, arachidic acid, behenic acid and mixtures thereof. The carboxylic acid can be or include one or more tall oil fatty acids. As used herein, "tall oil fatty acids" or "TOFA", consistent with industry standards, encompasses compositions that can include a mixture of rosin acids, fatty acids, triglycerides, sterols, high-molecular weight alcohols, and/or other alkyl chain materials. Tall oil refers to the resinous yellow-black oily liquid obtained as an acidified byproduct in the Kraft or sulfate processing of pine wood. As recognized by those skilled in tall oil chemistry, the actual distribution of these three major constituents in a crude tall oil depends on a variety of factors, such as the particular coniferous species of the wood being processed (wood type), the geographical location of the wood source, the age of the wood, the particular season that the wood is harvested, and others. Thus, depending on the particular source, crude tall oil can contain of about 20-75 wt % fatty acids (more often 30-60 wt %), of about 20-65 wt % rosin acids (more often 30-60%) and the balance being the neutral and non-saponifiable components, but crude tall oil usually contains at least 5 wt % neutral and non-saponifiable components. Usually, crude tall oil contains at least 8 wt % by weight neutral and non-saponifiable components and often 10 wt % or higher neutral and non-saponifiable components. One or more of TOFA can be concentrated be fractional distillation of the crude tall oil. Fatty acid triglycerides can be present in an amount of less than 10 wt %, less than 5 wt %, or less than 2.5 wt % of the collector composition.

Distillation of crude tall oil is often used to recover a mixture of fatty acids in the $C_{16}$-$C_{20}$ range. Fatty acids found in tall oils include, but are not limited to, oleic acid, linoleic acid, stearic acid, and palmitic acid. Rosin acids found in tall oils, include, but are not limited to, abietic acid, dehydroabietic acid, isopimaric acid, and pimaric acid. Examples of tall oil distillation products that can be used as the fatty acids or at to make up at least a portion of the fatty acids discussed and described herein can include, but are not limited to, tall oil fatty acids, distilled tall oil (DTO), tall oil pitch, or any mixture thereof.

The distilled tall oil fraction can have a fatty acids and esters of fatty acids concentration from a low of about 55 wt %, about 60 wt %, or about 65 wt % to a high of about 85 wt %, about 90 wt %, or about 95 wt %. The distilled tall oil fraction can have a rosin acids or rosins concentration from a low of about 5 wt %, about 10 wt %, or about 15 wt % to a high of about 30 wt %, about 35 wt %, or about 40 wt %. The distilled tall oil fraction can have a neutrals concentration from a low of about 0.1 wt %, about 1 wt %, or about 1.5 wt % to a high of about 2 wt %, about 3.5 wt %, or about 5 wt %. The distilled tall oil fraction can have an acid value from a low of about 20, about 25, or about 30 to a high of about 40, about 45, or about 50. The distilled tall oil fraction can have a viscosity (centipoise at 85° C.) from a low of about 10 cP, about 20 cP, about 30 cP, or about 40 cP to a high of about 100 cP, about 120 cP, about 135 cP, or about 150 cP. The distilled tall oil can have a density from a low of about 840 g/L, about 860 g/L, or about 880 g/L to a high of about 900 g/L, about 920 g/L, or about 935 g/L. The distilled tall oil fraction can have a saponification number from a low of about 180, about 185, or about 190 to a high of about 200, about 205, or about 210. The distilled tall oil fraction can have an iodine value from a low of about 115, about 117, or about 120 to a high of about 130, about 135, or about 140.

The commercially available tall oil products XTOL® 100, LYTOR® 100, XTOL® 300, XTOL®304, and XTOL®520 DTO (all from Georgia-Pacific Chemicals LLC, Atlanta, Ga.), for example, all contain saturated and unsaturated fatty acids in the $C_{16}$-$C_{18}$ range, as well as minor amounts of rosin acids. XTOL®100 includes about 1.6 wt % of palmitic acid, about 2.5 wt % of stearic acid, about 37.9 wt % of oleic acid, about 26.3 wt % of linoleic acid, about 0.3 wt % of linolenic acid, about 2.9 wt % of linoleic isomers, about 0.2 wt % of arachidic acid, about 3.6 wt % eicosatrienoic acid, about 1.4 wt % of pimaric acid, less than 0.16 wt % of sandarocopimaric, less than 0.16 wt % of isopimaric acid, less than 0.16 wt % of dehydroabietic acid, about 0.2 wt % of abietic acid, with the balance being neutrals and high molecular weight species. LYTOR® 100 includes less than 0.16 wt % of palmitic acid, less than 0.16 wt % of stearic acid, about 0.2 wt % of oleic acid, about 0.2 wt % of arachidic acid, about 0.2 wt % eicosatrienoic acid, about 2.2 wt % of pimaric acid, about 0.6 wt % of sandarocopimaric, about 8.5 wt % of palustric acid, about 1.6 wt % of levopimaric acid, about 2.8 wt % of isopimaric acid, about 15.3 wt % of dehydroabietic acid, about 51.4 wt % of abietic acid, about 2.4 wt % of neoabietic acid, with the balance being neutrals and high molecular weight species. XTOL®520 DTO includes about 0.2 wt % of palmitic acid, about 3.3 wt % of stearic acid, about 37.9 wt % of oleic acid, about 26.3 wt % of linoleic acid, about 0.3 wt % of linolenic acid, about 2.9 wt % of linoleic isomers, about 0.2 wt % of arachidic acid, about 3.6 wt % eicosatrienoic acid, about 1.4 wt % of pimaric acid, less than 0.16 wt % wt % of sandarocopimaric, less than 0.16 wt % of isopimaric acid, less than 0.16 wt % of dehydroabietic acid, about 0.2 wt % of abietic acid, with the balance being neutrals and high molecular weight species. Such tall oil products can be used in the reaction with the polyamine or a mixture of polyamines. Other fatty acids and mixtures of fatty acids, including oxidized and/or dimerized tall oil, such those discussed below can also be employed.

The carboxylic acid reactants can include rosin acids. The carboxylic acid reactants can have tricyclic acid structures such as abietic-type acids and pimaric-type acids, which the molecular formula $C_{19}H_{29}COOH$. Illustrative abietic-type acids can include, but are not limited to, abietic acid, abieta-7,13-dien-18-oic acid, 13-isopropylpodocarpa-7,13-dien-15-oic acid, neoabietic acid, dehydroabietic acid, palustric acid, levopimaric acid, and mixtures thereof. The structural formula for abietic acid is shown below.

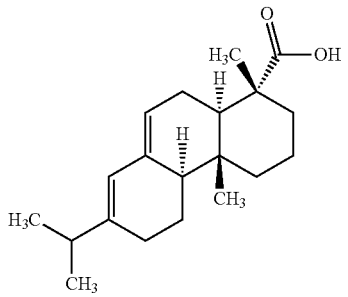

Abietic Acid

Illustrative pimaric-type acids can include, but are not limited to, pimaric acid, pimara-8(14),15-dien-18-oic acid, isopimaric acids, and mixtures thereof. The structural formula for pimaric acid is shown below.

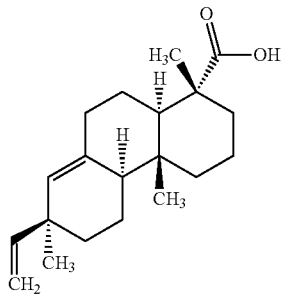

Pimaric Acid

The rosin acids can include tall oil rosin. The rosin acids can be derived from crude tall oil and/or an intermediate fraction that can be produced from the distillation of crude tall oil. The tall oil rosin can have a concentration of rosin acids from a low of about 80 wt %, about 85 wt %, or about 90 wt % to a high of about 93 wt %, about 95 wt %, or about 99 wt %. The tall oil rosin can have a concentration of abietic acid from a low of about 35 wt %, about 40 wt %, or about 43 wt % to a high of about 50 wt %, about 55 wt %, or about 60 wt %. The tall oil rosin can have a concentration of dehydroabietic acid from a low of about 10 wt %, about 13 wt %, or about 15 wt % to a high of about 20 wt %, about 23 wt %, or about 25 wt %. The tall oil rosin can have a concentration of isopimaric acid of about 10 wt % or less, about 8 wt % or less, about 5 wt % or less, or about 3 wt % or less, based on the total weight of the tall oil rosin. The tall oil rosin can have a concentration of pimaric acid of about 10 wt % or less, about 8 wt % or less, about 5 wt % or less, or about 3 wt % or less, based on the total weight of the tall oil rosin. The tall oil rosin can have a fatty acids concentration from a low of about 0.5 wt %, about 1 wt %, or about 2 wt % to a high of about 3 wt %, about 5 wt %, or about 10 wt %, based on the total weight of the tall oil rosin. The tall oil rosin can have a concentration of neutral materials from a low of about 0.5 wt %, about 1 wt %, or about 2 wt % to a high of about 3 wt %, about 5 wt %, or about 10 wt %, based on the total weight of the tall oil rosin. The tall oil rosin can have a density from a low of about 960 g/L, about 970 g/L, or about 980 g/L to a high of about 1,000 g/L, about 1,010 g/L, or about 1,020 g/L. The tall oil rosin can have an acid value from a low of about 150, about 160, or about 165 to a high of about 170, about 175, or about 180.

The carboxylic acid derivative reactant of Formula II can also be or include one or more triglycerides. Most plant and animal oils are mixtures of triglycerides and fatty acids. Triglycerides are generally produced or otherwise made from fatty acids having about 10 carbon atoms to about 24 carbon atoms and from 0 unsaturated carbon bonds to about 3 unsaturated carbon bonds in their chains. Some triglycerides are made from hydroxyl fatty acids that have an alcohol group somewhere in the chain, e.g., castor oil. Vegetable oils such as canola and corn oil can be used as feedstocks for the carboxylic acids. Through the use of known saponification techniques, a number of vegetable oils (triglycerides), such as linseed (flaxseed) oil, castor oil, tung oil, soybean oil, cottonseed oil, olive oil, canola oil, corn oil, sunflower seed oil, peanut oil, coconut oil, safflower oil, palm oil and mixtures thereof, to name just a few, can be used as a source of the fatty acid(s) for making a collector composition. In some examples, a source of fatty acids can be tall oil. One particular source of fatty acid can be distilled tall oil containing no more than about 6% rosin acid and other constituents and referred to as TOFA.

Suitable polyamines can be represented by the following chemical Formula (III):

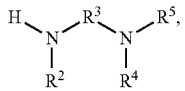

(III)

where $R^2$, $R^3$, $R^4$, and $R^5$ can be as discussed and described above with respect to Formula I. The amino groups can be primary, secondary, and/or tertiary amines. Illustrative polyamines can include, but are not limited to, diethylenetriamine ("DETA"); 1,3-diaminopentane ("DAMP"); N-(hydroxyethyl)ethylenediamine; 3-(dimethylamino)-1-propylamine; aminoguanidine bicarbonate; 1,5-diamino-2-methylpentane; lysine.HCl, diaminoisophorone; 1,2-diaminopropane; 2,4-diaminotoluene; 2,4-diaminobenzene sulfonic acid; N,N-dimethylaminopropyl-N-proplyenediamine; 3-(N,N-diethylamino)propylamine, 2-amino-4-methylpyridine; 2-(N,N-diethylamino)ethylamine; 2-amino-6-methylpyridine; 2-aminothiazole; aminoguanidine carbonate; aminoethylpiperazine; 1-methylpiperazine; L-arginine; 2-aminopyrimidine; aminoethylaminopropyltrimethoxysilane; 2-aminopyridine; 5-aminotetrazole; 2-amino-3-methylpyridine; 2-aminobenzothiazole; 3-aminomethylpyridine; 3-picolylamine; 3-morpholinopropylamine; 1-ethylpiperazine; N-methylpropylenediamine, histidine; L-monohydrochloride monohydrate; aminoethylaminoethylaminopropyltrimethoxysilane; 3-aminopyridine; N-ethylethylenediamine; aminopropylimidazole; 2-methylpiperazine; 2-amino-5-diethylaminopentane; 3-amino-1,2,4-triazole; aminoguanidine hydrochloride; 2-(N,N-dimethylamino)ethylamine; L-ornithine-monohydrochloride; L-histidine-free base 99%; N-(aminoethyl)morpholine; L-tryptophan, adenine phosphate; 6-aminopurine (adenine); agmatine sulfate; tryptamine[2-(1H-indol-3-yl)ethanamine]; histamine; 1-[2-[[2-[(2-aminoethyl)amino]ethyl]amino]ethyl]-piperazine); N-[(2-aminoethyl)2-aminoethyl]piperazine)]; 5,6-diamino-2-thiouracil; adenosine; adenosine 3',5'-cyclic monophosphate; adenosine 3',5'-cyclic monophosphate; S-adenosylmethionine, S-adenosyl homocysteine; 5-hydroxylysine; L(+)-ornithine-ketoglutarate; L-ornithine ethyl ester DiHCl; L-ornithine ethyl ester HCl; L-ornithine; L-aspartate; carnosine (β-alanyl-L-histidine); serotonin (5-hydroxytryptamine); 5-hydroxytryptophan; N-methyltryptamine; norbaeocystin (4-phosphoryloxy-tryptamine); 5,6-dibromotryptamine; 6-bromotryptamine; mimosine[3-hydroxy-4-oxo-1-(4H)-pyridinealanine]; anserine (beta-alanyl-N-methylhistidine); monatin, 3-hydroxykynurenine [2-amino-4-(2-amino-3-hydroxyphenyl)-4-oxobutanoic acid]; kynurenine[2-Amino-4-(2-aminophenyl)-4-oxobutanoic acid]; β-methylamino-L-alanine, diphthamide[2-amino-3-[2-(3-carbamoyl-3-trimethylammonio-propyl)-3H-imidazol-4-yl]propanoate]; ibotenic acid [(S)-2-amino-2-(3-hydroxyisoxazol-5-yl) acetic acid]; saccharopine[2-[(5-amino-5-carboxy-pentyl)amino]pentanedioic acid]; hypusine[(R)—N6-(4-amino-2-hydroxybutyl)-L-lysine]; (S)-aminoethyl-L-cysteine[(R)-2-amino-3-(2-amino-ethylsulfanyl)-propionic acid]; 4-aminopiperidine; 3-aminopiperidine; 2,4-diaminobenzoic acid; 1,2-diaminoanthraquinone; 2,3-diaminophenol; 2,4-diaminophenol; 2,3-diaminopropionic acid; 1-amino-4-methylpiperidine; 4-(aminomethyl)piperidine; 4-amino-2,2,6,6-tetramethylpiperidine; 3-aminopyrrolidine; 4-aminobenzylamine; 2-aminobenzylamine; or any mixtures thereof.

Standard coupling reagents can be applied to activate the carboxylic acid prior to the condensation reaction. The carboxylic acid and/or carboxylic acid derivative can be mixed with a coupling reagent such as 1-ethyl-3-(3-dimethylaminopropyl) carbodiimide) ("EDC") or (EDC.HCl), N,N'-dicyclohexylcarbodiimide ("DCC"), O-benzotriazole-N,N,N',N'-tetramethyl-uronium-hexafluoro-phosphate ("HBTU") or O-(benzotriazol-1-yl)-N,N,N',N'-tetramethyl-uronium tetrafluoroborate ("TBTU") in an inert solvent such as N,N-dimethylformamide, dimethylacetamide ("DMA") or dichloromethane ("DCM") together with the desired polyamine. Optionally a base (e.g., N,N-diisopropylethyl amine, triethylamine, N-methyl morpholine, and/or 1-hydroxybenzotriazole ("HOBT")) can be added. The reaction mixture can be stirred for about 1 hour to about 24 hours at a temperature of about −30° C. to about 70° C.

Suitable amines can be represented by the following chemical Formula (IV):

$$R^6—NH_2, \quad (IV)$$

where $R^6$ can be a $(C_1-C_{24})$alkyl, a phenyl, a benzyl, a $(C_1-C_{24})$alkenyl, a heterocyclyl, an unsubstituted aryl, and an aryl substituted by one or more $(C_1-C_8)$alkyl substituents.

The collector composition can include the amidoamine of Formula I and the amine of Formula IV in any amount with respect to one another. For example, the collector composition can include the amidoamine in an amount of about 1 wt %, about 5 wt %, about 10 wt %, about 15 wt %, about 20 wt %, about 25 wt %, about 30 wt %, about 35 wt %, about 40 wt %, about 45 wt %, about 50 wt %, about 55 wt %, about 60 wt %, about 65 wt %, about 70 wt %, about 75 wt %, about 80 wt %, about 85 wt %, about 90 wt %, about 95 wt %, or about 99 wt %, based on the total weight of the amidoamine(s) and the amine(s). In another example, the weight ratio of the amidoamine to the amine in the collector composition can be about 99:1 to about 1:99, about 90:10 to about 10:90, about 80:20 to about 20:80, about 70:30 to about 30:70, about 65:35 to about 35:65, about 60:40 to about 40:60, about 55:45 to about 45:55, or about 50:50.

The optionally added etheramines can be represented by the chemical Formula (V):

$$R^7—O—R^8—NH_2, \quad (V)$$

where $R^7$ can be selected from a hydrogen, a $(C_1-C_{18})$alkyl, a halogen-$(C_1-C_{18})$alkyl, a phenyl, a $(C_1-C_6)$alkenyl, a heterocyclyl, an unsubstituted aryls, and an aryls substituted by one or more substituents selected from a halogen, a $(C_1-C_{18})$alkyl, and a halogen-$(C_1-C_{18})$alkyl; and $R^8$ can be a $(C_1-C_6)$alkylene, a halogen-$(C_1-C_6)$alkylene, a phenylene, a $(C_1-C_6)$alkenylene, heterocyclylene, an unsubstituted arylene, and an arylene substituted by one or more substituents selected from a halogen, a $(C_1-C_6)$alkyl, and a halogen-$(C_1-C_6)$alkyl.

Other suitable etheramines can include ether diamines represented by the following chemical Formula (VI):

$$R^9—O—R^{10}—NH—R^{11}—NH_2, \quad (VI)$$

where $R^9$ can be a hydrogen, a $(C_1-C_{18})$alkyl, a halogen-$(C_1-C_{18})$alkyl, a phenyl, a $(C_1-C_{18})$alkenyl, a heterocyclyl, an unsubstituted aryls, and an aryl substituted by one or more substituents selected from a halogen, a $(C_1-C_{18})$alkyl, and a halogen-$(C_1-C_{18})$alkyl; and $R^{10}$ and $R^{11}$ can independently be selected from a $(C_1-C_6)$alkylene, a halogen-$(C_1-C_6)$alkylene, a phenylene, a $(C_1-C_6)$alkenylene, a heterocyclylene, an unsubstituted arylene, and an arylene substituted by one or more substituents selected from a halogen, a $(C_1-C_6)$alkyl, and a halogen-$(C_1-C_6)$alkyl.

The amidoamines of Formula I and the etheramines of Formula V and/or Formula VI can be combined with one another to form a collector in any desired amount with respect to one another to provide or produce a collector composition. For example, the collector composition can include the amidoamine in an amount of about 1 wt %, about 5 wt %, about 10 wt %, about 15 wt %, about 20 wt %, about 25 wt %, about 30 wt %, about 35 wt %, about 40 wt %, about 45 wt %, about 50 wt %, about 55 wt %, about 60 wt %, about 65 wt %, about 70 wt %, about 75 wt %, about 80 wt %, about 85 wt %, about 90 wt %, about 95 wt %, or about 99 wt %, based on the total weight of the amidoamine(s) and the etheramine(s). In another example, the weight ratio of the amidoamine(s) to the etheramine(s) in the collector composition can be about 99:1 to about 1:99, about 90:10 to about 10:90, about 80:20 to about 20:80, about 70:30 to about 30:70, about 65:35 to about 35:65, about 60:40 to about 40:60, about 55:45 to about 45:55, or about 50:50.

The amidoamines of Formula I, the amine of Formula IV, and the etheramines of Formula V and/or Formula VI can be mixed with one another to form a collector in any desired amount with respect to one another to provide or produce a collector composition. For example, the collector composition can include about 1 wt % to about 98 wt % of the amidoamine of formula I, about 1 wt % to about 98 wt % of the amine of Formula IV, and about 1 wt % to about 98 wt % of the etheramine of Formula V and/or Formula VI. In another example, the collector composition can have the amidoamine in an amount of about 1 wt %, about 5 wt %, about 10 wt %, about 15 wt %, about 20 wt %, about 25 wt %, about 30 wt %, about 35 wt %, about 40 wt %, about 45 wt %, about 50 wt %, about 55 wt %, about 60 wt %, about 65 wt %, about 70 wt %, about 75 wt %, about 80 wt %, about 85 wt %, about 90 wt %, about 95 wt %, or about 98 wt %, based on the total weight of the amidoamine(s), the amine(s), and the etheramine(s). In another example, the collector composition can have the amine in an amount of about 1 wt %, about 5 wt %, about 10 wt %, about 15 wt %, about 20 wt %, about 25 wt %, about 30 wt %, about 35 wt %, about 40 wt %, about 45 wt %, about 50 wt %, about 55 wt %, about 60 wt %, about 65 wt %, about 70 wt %, about 75 wt %, about 80 wt %, about 85 wt %, about 90 wt %, about 95 wt %, or about 98 wt %, based on the total weight of the amidoamine(s), the amine(s), and the etheramine(s). In another example, the collector composition can have the etheramine in an amount of about 1 wt %, about 5 wt %, about 10 wt %, about 15 wt %, about 20 wt %, about 25 wt %, about 30 wt %, about 35 wt %, about 40 wt %, about 45 wt %, about 50 wt %, about 55 wt %, about 60 wt %, about 65 wt %, about 70 wt %, about 75 wt %, about 80 wt %, about 85 wt %, about 90 wt %, about 95 wt %, or about 98 wt %, based on the total weight of the amidoamine(s), the amine(s), and the etheramine(s). In another example, the collector composition can have a weight ratio of the amidoamine to the amine of the Formula IV of about 98:1 to about 1:98, about 89:10 to about 10:89, about 79:20 to about 20:79, about 69:30 to about 30:69, about 64:35 to about 35:64, about 59:40 to about 40:59, about 54:45 to about 44:55, or about 50:49 to about 49:50. In another example, the collector composition can have a weight ratio of the amidoamine to the etheramine of the Formula V and/or Formula VI of about 98:1 to about 1:98, about 89:10 to about 10:89, about 79:20 to about 20:79, about 69:30 to about 30:69, about 64:35 to about 35:64, about 59:40 to about 40:59, about 54:45 to about 44:55, or about 50:49 to about 49:50. In another example, the collector composition can have a weight ratio of the amine of the Formula IV to the etheramine of the Formula V and/or Formula VI of about 98:1 to about 1:98, about 89:10 to about 10:89, about 79:20 to about 20:79, about 69:30 to about 30:69, about 64:35 to about 35:64, about 59:40 to about 40:59, about 54:45 to about 44:55, or about 50:49 to about 49:50

The amidoamine of Formula I, the amine of Formula IV, the etheramine of Formula V, and the ether diamine of Formula VI can be converted to ammonium salts by the reaction with acid before using in the collector composition. Suitable acids for conversion of amines to ammonium salts include acetic, formic, hydrochloric, sulfuric, phosphoric, methane sulfonic, toluene sulfonic benzene sulfonic, propionic, lactic, glycolic, oxalic, malic, malonic, fumaric, maleic, and many others.

The dosage or amount of the collector composition that can be added to an aqueous slurry of an ore can be from a low of about 1 g, about 10 g, about 20 g, or about 30 g to a high of about 50 g, about 60 g, about 70 g, about 90 g, about 120 g, about 150 g, about 175 g, about 275 g, about 375 g, or about 500 g per tonne of ore. In another example the amount of the collector composition can be about 60 g/tonne, about 80 g/tonne, about 90 g/tonne, about 100 g/tonne, about 110 g/tonne, about 120 g/tonne, about 125 g/tonne, about 130 g/tonne, about 140 g/tonne, about 150 g/tonne, about 175 g/tonne, about 275 g/tonne, about 375 g/tonne, or about 500 g/tonne.

A concentrate recovered from a froth flotation process that uses the collector composition can have a silica concentration of less than 10 wt %, less than 8 wt %, less than 7 wt %, less than 6 wt %, less than 5 wt %, less than 4 wt %, less than 3 wt %, less than 2 wt %, less than 1 wt %, or less than 0.5 wt %, based on the solids weight of the concentration. The concentrate recovered from the froth flotation process that uses the collector composition can have an iron concentration of about 85 wt % or more, about 87 wt % or more, about 88 wt % or more, about 89 wt % or more, about 90 wt % or more, about 91 wt % or more, about 92 wt % or more, about 93 wt % or more, about 94 wt % or more, or about 95 wt % or more. The iron in a reject portion recovered from a froth flotation process that uses the collector composition can be less than 35 wt %, less than 33 wt %, less than 30 wt %, less than 27 wt %, less than 25 wt %, or less than 23 wt %.

The collector composition can also be used in combination with one or more frothers and/or one or more depressants. To avoid, in the case of silicate flotation from iron ore, this being co-discharged, hydrophilic polysaccharides, such as, for example, modified starch, carboxymethyl cellulose (CMC) or gum arabic, can be added as depressants in dosages of about 10 g/tonne to about 1,000 g/tonne.

Silicate flotation can be carried out at a pH of about 7 to about 12, e.g., about 8 to about 11. The pH of the aqueous mixture to be separated can be set or adjusted, for example, via addition of sodium hydroxide, potassium hydroxide, or other alkaline reagents.

The collector composition containing one or more amidoamines, one or more amines, and, optionally, one or more etheramines can be used in froth flotation processes for the beneficiation of a wide variety of unpurified or crude materials. Illustrative purifiable or purified materials can include, but are not limited to, minerals or metals such as phosphate, potash, lime, sulfate, gypsum, iron, platinum, gold, palladium, titanium, molybdenum, copper, uranium, chromium, tungsten, manganese, magnesium, lead, zinc, clay, coal, silver, graphite, nickel, bauxite, borax, borate, high molecular weight hydrocarbons such as bitumen, oxides thereof, complexes thereof, salts thereof, or any mixture thereof. In some embodiments, purifiable or purified materials can include, but are not limited to, iron, iron oxides (e.g., ferric and/or ferrous oxides), phosphorous, phosphorous oxides, phosphates, oxides thereof, complexes thereof, salts thereof, and mixture thereof. Often, the raw or crude materials to be purified and recovered contain sand and/or clay. The collector compositions containing the one or more amidoamines and the one or more amines can be selective toward sand and/or clay.

Although clay is often considered an impurity in conventional metal or mineral ore beneficiation, clay can also be present in relatively large quantities, and can be the desired or purifiable material or main component to be recovered. Some clays, for example kaolin clay, are purifiable minerals that can be used in a number of applications, such as mineral fillers in the manufacture of paper and rubber. Thus, one froth flotation process in which the collector composition can be employed can include the separation of clay from a clay-containing ore. The impurities in such ores can be metals and their oxides, such as iron oxide and titanium dioxide, which can be floated via froth flotation. Other impurities of clay-containing ores include coal. For example, impurities present in most Georgia kaolin include iron-bearing titania and various minerals such as mica, ilmenite, and/or tourmaline, which are generally also iron-containing. Thus, the clay, which selectively associates with the collector composition, is separately recoverable from metals, metal oxides, and coal.

The separation processes discussed and described herein are applicable to suspensions, dispersions, and slurries of solid particles. These terms are sometimes defined equivalently and sometimes are distinguished based on the need for the input of at least some agitation or energy to maintain homogeneity in the case of a "slurry." As used herein, however, the terms "suspension" and "slurry" are used interchangeably with one another.

In one or more embodiments, the purification of clay, the collector composition can include one or more anionic collectors, flocculants, clay dispersants, or any mixture thereof to control frothing. The anionic collector can be or include oleic acid, the flocculant can be or include one or more polyacrylamides, the clay dispersant can be or include one or more fatty acids, one or more rosin acids, one or more oils, or any mixture thereof.

The collector composition can be used in froth flotation processes for the beneficiation of coal, phosphate or potash, as well as other purifiable materials, including metals and minerals discussed above, in which the removal of siliceous gangue materials such as sand and/or clay and other impurities is an important factor in achieving favorable process economics. Potassium ores and other ores, for example, generally comprise a mixture of minerals in addition to sylvite (KCl), which is desirably recovered in the froth concentrate. Other ores include halite (NaCl), clay, and carbonate minerals which are non-soluble in water, such as aluminum silicates, calcite, dolomite, and anhydrite. Other ore impurities include iron oxides, titanium oxides, iron-bearing titania, mica, ilmenite, tourmaline, aluminum silicates, calcite, dolomite, anhydrite, ferromagnesian, feldspar, and debris or various other solid impurities such as igneous rock and soil. In the case of coal beneficiation, non-combustible solid materials such as calcium magnesium carbonate are considered impurities.

Coals to be beneficiated can include anthracite, lignite, bituminous, sub-bituminous, and the like. The coal can be pulverized and cleaned using any available technology. Ultimately, an aqueous slurry of coal particles having a concentration of solids which promotes rapid flotation can be prepared. Generally, a solids concentration of about 2 wt % to about 25 wt % coal solids, more usually of about 5 wt % to about 15 wt %, is suitable.

The average particle size diameter of the coal in the flotation feed can be less than 600 μm. For example, the coal particles in the flotation feed to be treated can have a average particle size diameter of less than 600 μm, less than 500 μm, less than 400 μm, less than 300 μm, less than 200 μm, less than 100 μm, or less than 50 μm.

The amount of the collector composition added to the aqueous coal slurry for obtaining the greatest recovery or collection of combustible coal particles with an acceptable ash content can be dependent, at least in part, on a variety of diverse factors such as particle size, coal rank, degree of surface oxidation, the initial ash content of the coal feed, and the amount of any frothing agents and/or other adjuvants added to the aqueous coal slurry. A suitable loading of the collector mixture can be determined by routine experiments. When the collector composition is employed with only a frothing agent, the collector composition can be present in an amount of about 0.001 wt % to about 0.4 wt %, or of about 0.005 wt % to about 0.1 wt %, based on the weight of coal solids in the aqueous coal slurry.

The collector composition can be used in combination with one or more frothing agents. A frothing agent can be used to promote the formation of a suitably structured froth. Illustrative frothing agents can include, but are not limited to, pine oils, cresol, 2-ethyl hexanols, aliphatic alcohols such as isomers of amyl alcohol and other branched $C_4$ to $C_8$ alkanols, polypropylene glycols, ethers, methyl cyclohexyl methanols, or any mixture thereof. Particularly suitable frothing agents can include, but are not limited to, methyl isobutyl carbinol (MIBC), polypropylene glycol alkyl, and/or phenyl ethers. The amount of frothing agent added to aqueous coal slurry can be influenced by a number of factors, which can include, but are not limited to, particle size, rank of the coal, and degree of oxidation of the coal. The amount of the frothing agent added to the aqueous slurry of coal can range of about 0.001 wt % to about 0.1 wt % or about 0.01 wt % to about 0.05 wt %, based on the weight of coal solids in the aqueous coal slurry.

The collector composition can be used for the separation of coal in combination with one or more other adjuvants or additives. For example, activators, conditioners, dispersants, depressants, pour point depressants, and/or freeze point depressants.

The addition of a pour point depressant or a freezing point depressant to the collector composition can be useful in cold climates for maintaining the fluidity of the collector composition. Suitable pour point depressants or freeze point depressants can include, but are not limited to, fatty acids esters, particularly when esterified with a low molecular weight alcohol like ethanol or methanol, poly alkyl acrylates, poly alkyl methacrylates, copolymers of styrene and dialkyl maleates, copolymers of styrene and dialkyl fumarates, copolymers of styrene and alkyl acrylates, copolymers of styrene and alkyl methacrylates, alkylphenoxy poly(ethylene oxide)ethanol, alkylphenoxy poly(propylene oxide) propane diol, propylene glycol, ethylene glycol, diethylene glycol, acetate salts, acetate esters, chloride salts, formate esters, formate salts, glycerin, diesters of diacids, copolymers of dialkyl fumarates and vinyl acetate, copolymers of dialkyl maleate and vinyl acetate, copolymers of alkyl acrylate and vinyl acetate, copolymers of alkyl methacrylate and vinyl acetate, or any mixture thereof. The pour point depressant can be present in an amount from a low of about 1 wt %, about 3 wt %, about 5 wt % or about 10 wt % to a high of about 30 wt %, about 40 wt %, about 50 wt %, or about 60 wt %, based on the weight of the collector composition.

The coal can be floated at the natural pH of the aqueous coal slurry, which usually can vary of about 3 to about 9.5 depending upon the composition of the feed. The pH, however, can optionally be adjusted to maintain the pH of the aqueous coal slurry prior to and during flotation at a value of about 4 to about 9 or about 5.5 to about 9. If the coal is acidic, the pH value of the aqueous coal slurry can be adjusted by including an alkaline material, such as soda ash, lime, ammonia, potassium hydroxide or magnesium hydroxide, and/or sodium hydroxide. If the aqueous coal slurry is alkaline, a carboxylic acid, such acetic acid, and/or a mineral acid, such as sulfuric acid and/or hydrochloric acid, can be used to adjust the pH, if desired.

The collector-treated and pH-adjusted aqueous coal slurry can be aerated in a conventional flotation machine or bank of rougher cells to float the coal. Any conventional flotation unit can be employed. The collector composition can be used to separate a wide variety of contaminants or gangue from a liquid, e.g., water. For example, the collector composition can be used to separate siliceous contaminants such as sand, clay, and/or ash from aqueous liquid suspensions or slurries containing one or more of these siliceous contaminants. Aqueous suspensions or slurries can therefore be treated with the collector composition allowing for the effective separation of at least a portion of the contaminants, in a contaminant-rich fraction, to provide a purified liquid. The contaminant-rich fraction contains a higher percentage of solid contaminants than originally present in the liquid suspension or slurry. Conversely, the purified liquid has a lower percentage of solid contaminants than originally present in the liquid suspension or slurry.

The treatment can involve adding an effective amount of the collector composition to interact with and either coagulate or flocculate one or more solid contaminants into larger agglomerates. An effective amount can be readily determined depending, at least in part, on a number of variables (e.g., the type and concentration of contaminant), as is readily appreciated by those having skill in the art. In other embodiments, the treatment can involve contacting the liquid suspension continuously with a fixed bed of the collector composition, in solid form.

During or after the treatment of a liquid suspension with the collector composition, the coagulated or flocculated solid contaminant (which can now be, for example, in the form of larger, agglomerated particles or flocs) can be removed. Removal can be affected by flotation (with or without the use of rising air bubbles as described previously with respect to froth flotation) or sedimentation. The optimal approach for removal will depend on the relative density of the flocs and other factors. Increasing the quantity of collector composition amine that can be used to treat the suspension can in some cases increase the tendency of the flocs to float rather than settle. Filtration or straining can also be an effective means for removing the agglomerated flocs of solid particulates, regardless of whether they reside predominantly in a surface layer or in a sediment.

Examples of liquid suspensions that can be purified include oil and gas drilling fluids, which accumulate solid particles of rock or drill cuttings in the normal course of their use. These drilling fluids are important in the drilling process for several reasons, including transporting these drill cuttings from the drilling area to the surface, where their removal allows the drilling mud to be recirculated. The addition of collector composition to oil well drilling fluids, including water-based (i.e., aqueous) drilling fluids, effectively coagulates or flocculates solid particle contaminants into larger clumps (or flocs), thereby facilitating their separation by settling or flotation. The collector composition can be used in conjunction with known flocculants such as polyacrylamides and/or hydrocolloidal polysaccharides. Generally, in the case of suspensions of water-based oil or gas drilling fluids, the separation of the solid contaminants can be sufficient to provide a purified drilling fluid for reuse in drilling operations.

Other kinds of aqueous suspensions can include the clay-containing aqueous suspensions or brines, which accompany ore refinement processes, including those described above. The production of purified phosphate from mined calcium phosphate rock, for example, generally relies on multiple separations of solid particulates from aqueous media, whereby such separations can be improved using the collector composition. In the overall process, calcium phosphate can be mined from deposits and the phosphate rock can be initially recovered in a matrix containing sand and clay gangue or impurities. The matrix can be mixed with water to form a slurry, which after mechanical agitation, can be screened to retain phosphate pebbles and to allow fine clay particles to pass through as a clay slurry effluent with large amounts of water.

These clay-containing effluents can have high flow rates and typically carry less than 10 wt % solids and more often contain only of about 1 wt % to about 5 wt % solids. The dewatering (e.g., by settling or filtration) of this waste clay, which allows for recycle of the water, poses a significant challenge for reclamation. The time required to dewater the clay, however, can be decreased through treatment of the clay slurry effluent, obtained in the production of phosphate, with the collector composition. Reduction in the clay settling time allows for efficient re-use of the purified water, obtained from clay dewatering, in the phosphate production operation. In one embodiment of the purification method, where the liquid suspension is a clay-containing effluent slurry from a phosphate production facility, the purified liquid can contain less than 1 wt % solids after a settling or dewatering time of less than 1 month.

In addition to the phosphate pebbles that can be retained by screening and the clay slurry effluent described above, a mixture of sand and finer particles of phosphate can also obtained in the initial processing of the mined phosphate matrix. The sand and phosphate in this stream can be separated by froth flotation which, as described above, can be improved using the collector composition as a depressant for the sand.

In the area of slurry dewatering, another specific application of the collector composition can be in the filtration of coal from water-containing slurries. The dewatering of coal is important commercially, since the BTU value per unit weight and hence the quality of the coal decreases with increasing water content. In one embodiment, therefore, the collector composition can be used to treat an aqueous coal-containing suspension or slurry prior to dewatering the coal by filtration.

As used herein, the term "beneficiation" broadly refers to any process for purifying and/or upgrading a crude, raw, or unpurified material to produce a beneficiated or purified material as described herein. In the case of coal ore purification, a number of beneficiation operations are conventionally used in an effort to improve the quality of coal that is burned, for example, in electricity-generating power plants. As discussed previously, for example, such quality improvement processes address environmental concerns that have resulted in lower tolerances for metallic contaminants such as mercury and arsenic, as well as nitrogen- and sulfur-containing compounds. Froth flotation, as discussed above, can be one method for the purification of a coal ore via treatment of an aqueous slurry of the ore with the collector composition. Treatment can alternatively occur prior to or during conventional coal size or density classification operations to facilitate the reduction in the amount(s) of one or more of the mercury, nitrogen, sulfur, silicon, ash, and pyrite impurities in the purified coal, wherein these impurities are measured on a volatile free weight basis and as described previously. The collector composition can also be used in conjunction with size or density classification operations to reduce moisture and/or increase the fuel value of the purified coal (e.g., measured in BTU/lb). The reduction of the amount(s) of one or more (e.g., two or more, or all) of the impurities described above, in the purified coal recovered in the size or density classification operation can be less than the corresponding reference amount(s) in a purified reference coal recovered in the same size or density classification operation, but without using the collector composition.

In general, the reduction of one of the impurities noted above in the purified coal, results in a corresponding reduction in the amount of one or more other undesired impurities. For example, a reduction in pyrite generally leads to a reduction in mercury and other inorganic materials such as silicon-containing ash. In one embodiment, the use of one or more size or density classification operations in conjunction with the collector composition results in a reduction in amounts of all the impurities noted above.

Suitable conventional size or density classification operations include cyclone separation, heavy medium (or heavy media or dense medium) separation, filtration, and/or screening, any of which can be used in combination (e.g., serially and/or in parallel) with each other or with froth flotation. Generally, these operations precede froth flotation to provide, in combination with froth flotation, an upgraded or purified coal meeting the various specifications (e.g., nitrogen and sulfur levels) required for combustion in electricity-generating power plants. For example, water-only or clarifying cyclone operations process a feed stream of a raw coal ore slurry, which can be fed tangentially under pressure into a cyclone. Centrifugal force can move heavier material to the cyclone wall, where it is subsequently typically transported to the underflow at the apex (or spigot). Lighter coal particles that are disposed toward the center of the cyclone can be removed via a pipe (or vortex finder) to the overflow. The targeted density at which light and heavy particles are separated can be adjusted by varying pressure, vortex finder length, and/or apex diameter. Such water-only or clarifying cyclones typically treat material in the size range of about 0.5 mm to about 1 mm and can involve two ore more stages of separation to improve separation efficiency.

Heavy medium separation can use a dense liquid medium (e.g., magnetite at a specified magnetite/water ratio) to float particles (e.g., coal) having a density below that of the medium and depress particles (e.g., sand or rock) having a density above that of the medium. Heavy medium separation can be employed in a simple deep or shallow "bath" configuration or can be included as part of a cyclone separation operation to enhance the gravitational separation forces with centrifugal forces. Often, one or more stages of a clarifying cyclone separation operation are followed by one or more stages of heavy medium cyclone separation and one ore more screening steps to yield an appropriately sized and purified (e.g., a pre-conditioned or pre-treated) coal feedstock for subsequent froth flotation.

Another application of the collector composition can be in the area of sewage treatment, accompanied by various processes that are undertaken to remove contaminants from industrial and municipal waste water. Such processes can purify sewage to provide both purified water that is suitable for disposal into the environment (e.g., rivers, streams, and oceans) as well as a "sludge." Sewage refers to any type of water-containing wastes which are normally collected in sewer systems and conveyed to treatment facilities. Sewage therefore includes municipal wastes from toilets (sometimes referred to as "foul waste") and basins, baths, showers, and kitchens (sometimes referred to as "sullage water"). Sewage can also include industrial and commercial waste water, (sometimes referred to as "trade waste"), as well as stormwater runoff from hard-standing areas such as roofs and streets.

Conventional processes for purifying sewage often involve preliminary, primary, and secondary steps. Preliminary steps often include the filtration or screening of large solids such as wood, paper, rags, as well as coarse sand and grit, which would normally damage pumps. Subsequent primary steps are then employed to separate most of the remaining solids by settling in large tanks, where a solids-rich sludge is recovered from the bottom of these tanks and processed further. A purified water is also recovered and normally subjected to secondary steps involving biological processes.

Thus, in one embodiment, the purification of sewage water by settling or sedimentation can comprise treating the sewage water, before or during the settling or sedimentation operation, with the collector composition. This treatment can be used to improve settling operation (either batch or continuous), for example, by decreasing the residence time required to effect a given separation (e.g., based on the purity of the purified water and/or the percent recovery of solids in the sludge). Otherwise, the improvement can be manifested in the generation of a higher purity of the purified water and/or a higher recovery of solids in the sludge, for a given settling time.

After treatment of sewage with the collector composition and removing a purified water stream by sedimentation, it is also possible for the collector composition to be subsequently used for or introduced into one or more secondary steps as described above to further purify the water. These secondary operations normally rely on the action of naturally occurring microorganisms to break down organic material. In particular, aerobic biological processes substantially degrade the biological content of the purified water recovered from primary steps. The microorganisms (e.g., bacteria and protozoa) consume biodegradable soluble organic contaminants (e.g., sugars, fats, and other organic molecules) and bind much of the less soluble fractions into flocs, thereby further facilitating the removal of organic material.

The collector composition can also be applied to the purification of pulp and paper mill effluents. These aqueous waste streams normally contain solid contaminants in the form of cellulosic materials (e.g., waste paper; bark or other wood elements, such as wood flakes, wood strands, wood fibers, or wood particles; or plant fibers such as wheat straw fibers, rice fibers, switchgrass fibers, soybean stalk fibers, bagasse fibers, or cornstalk fibers; and mixtures of these contaminants). The effluent stream containing one or more cellulosic solid contaminants can be treated with the collector composition and purified water can be removed via sedimentation, flotation, and/or filtration.

In the separation of bitumen from sand and/or clay impurities as described previously, various separation steps can be employed either before or after froth flotation of the bitumen-containing slurry. These steps can include screening, filtration, and/or sedimentation, any of which can benefit from treatment of the oil sand slurry with the collector composition, followed by removal of a portion of the sand and/or clay contaminants in a contaminant-rich fraction (e.g., a bottoms fraction) or by removal of a purified bitumen fraction. As described above with respect to phosphate ore processing, water effluents, which generally contain solid clay particles, can be subjected to a treating step that can include flocculating the contaminants to facilitate their removal (e.g., by filtration). Waste water effluents from bitumen processing facilities can also contain sand and/or clay impurities and therefore can benefit from treatment with the collector composition to dewater the waste water effluents and/or remove at least a portion of the solid impurities in a contaminant-rich fraction. A particular process stream of interest that can be generated during bitumen extraction is known as the "mature fine tails," which is an aqueous suspension of fine solid particulates that can benefit from dewatering. Generally, in the case of sand and/or clay containing suspensions from a bitumen production facility, separation of the solid contaminants can be sufficient to allow the recovery, collection, and/or removal of a purified liquid or water stream that can be recycled to the bitumen process.

The treatment of various intermediate streams and effluents in bitumen production processes with the collector composition is not limited only to those process streams that are at least partly subjected to froth flotation. As is readily appreciated by those of skill in the art, other techniques (e.g., centrifugation via the "Syncrude Process") for bitumen purification will generate aqueous intermediate and byproduct streams from which solid contaminant removal is desirable.

The collector composition can be employed in the removal of suspended solid particulates, such as sand and clay, in the purification of water, and particularly for the purpose of rendering it potable. Moreover, the collector composition can have the additional ability to complex metallic cations (e.g., lead and mercury cations) allowing these unwanted contaminants to be removed in conjunction with solid particulates. Therefore, the collector composition can be used to effectively treat impure water having both solid particulate contaminants as well as metallic cation contaminants. Without being bound by theory, it is believed that electronegative moieties, such as the carbonyl oxygen atom on the collector composition, complex with undesired cations to facilitate their removal. Generally, this complexation occurs when the water is at a pH of greater than 5, and typically at a pH of about 7 to about 9.

Another possible mechanism for the removal of metallic cations can be based on the cationic association with negatively charged solid particulates. Flocculation and removal of these particulates will therefore also cause, at least to some extent, the removal of metallic cations. Regardless of the mechanism, in one embodiment, the treatment and removal of both of these contaminants can be carried out to yield potable water.

EXAMPLES

In order to provide a better understanding of the foregoing discussion, the following non-limiting examples are offered. Although the examples can be directed to specific embodiments, they are not to be viewed as limiting the invention in any specific respect.

Flotation experiments were performed on various combinations and concentrations of amidoamines of Formula I, amines of Formula IV, and etheramines of Formula V. The flotation experiments for Examples 2-6 and 8-21 were performed on a phosphate cleaner feed supplied by the Mosaic Company. The flotation experiments for Example 7 were performed on a phosphate cleaner feed collected in November 2012 and supplied by the CF Industries, Inc. The flotation experiments for Examples 1, 22, and 23 were performed on a phosphate cleaner feed collected in January 2013 and supplied by the CF Industries, Inc. In this phosphate reverse cleaner stage, the cleaner feed was conditioned at approximately 70 wt % solids and neutral pH with the addition of the collector composition for five minutes in a 2 L stainless steel beaker at 1,500 rpm using a Denver D12 Laboratory Flotation Machine. The conditioned ore was transferred to a two-liter Denver cell for flotation. The solids content was lowered to 25 wt % for flotation. The ore was agitated for approximately 15-30 seconds before the air was introduced into the cell. Once the froth began to form, it was pulled for two minutes. After the two minute flotation step was completed, the two separate components, phosphate concentrate and silica tail, were separately filtered and dried. The dried tail samples were slightly ground in a mortar and pestle, and a small portion was collected for analysis. The dried concentrate samples were mixed well, and a small portion was collected for analysis. Bone phosphate of lime (BPL) analysis and inductively coupled plasma analysis (ICP) on the acid insolubles (A.I.) were performed on the samples.

Comparative Example 1

TOMAMINE® PA-14 was used as a comparative example (C1) for the inventive collector compositions. TOMAMINE® PA-14 is an etheramine purchased from Air Products and Chemicals, Inc. (Allentown, Pa.). TOMAMINE® PA-14 is composed of 95 wt % of 3-(8-methylnonoxy)propan-1-amine and 3 wt % of 8-methylnonan-1-ol. Table 1 shows the dosage and performance of the TOMAMINE® PA-14 as the collector.

TABLE 1

C1 (TOMAMINE ® PA-14)

| Collector Dosage (lb/t) | % $P_2O_5$ Recov. | % $P_2O_5$ Grade | % A.I. Reject | % A.I. Grade | Mass recovery | Separation Efficiency |
|---|---|---|---|---|---|---|
| 0.50 | 97.08 | 29.72 | 28.50 | 13.84 | 92.44 | 25.58 |
| 0.75 | 97.06 | 32.42 | 63.45 | 7.49 | 86.29 | 60.51 |
| 1.00 | 96.29 | 32.78 | 74.29 | 5.53 | 83.57 | 70.58 |
| 1.25 | 95.70 | 32.94 | 79.06 | 4.58 | 82.22 | 74.76 |
| 1.50 | 94.82 | 33.50 | 84.53 | 3.45 | 80.50 | 79.35 |
| 2.00 | 93.50 | 33.84 | 89.52 | 2.40 | 78.34 | 83.02 |
| 2.50 | 92.61 | 33.87 | 91.33 | 2.01 | 77.26 | 83.94 |
| 3.00 | 92.27 | 33.66 | 92.27 | 1.78 | 77.10 | 84.54 |
| 3.50 | 92.76 | 33.79 | 90.94 | 2.10 | 77.43 | 83.70 |

The separation efficiency is defined as $E_s=R-R_g$, where R is the amount of purifiable material in the concentrate and $R_g$ is the amount of waste material in the concentrate.

Example 1

A coconut fatty acid-DETA amidoamine was produced by allowing 1 mole of coconut fatty acid (TRC-101, from Twin River Technologies, Inc.) to react with 1.3 moles of diethylenetriamine (Sigma-Aldrich Chemicals, Co.) at 170° C. while collecting the condensate. The resulting amidoamine was neutralized at 70° C. with glacial acetic acid (Sigma-Aldrich Chemicals, Co.). The collector composition was 50 wt % of the neutralized product, 37 wt % of water, and 13 wt % of F-663 (Butyl Tri Glycol Ether ("BTGE") frother from SNF Flomin) Table 2 shows the collector dosage and performance of the coconut fatty acid-DETA amidoamine collector Ex.1.

TABLE 2

Ex. 1 (Coconut fatty acid-DETA Amidoamine)

| Collector Dosage (lb/t) | % $P_2O_5$ Recov. | % $P_2O_5$ Grade | % A.I. Reject | % A.I. Grade | Mass recovery | Separation Efficiency |
|---|---|---|---|---|---|---|
| 2.00 | 98.66 | 28.29 | 39.53 | 12.13 | 91.49 | 38.18 |

Example 2

A coconut oil-DETA amidoamine was produced by allowing 1 mole of coconut oil (LOU ANA® by Ventura Foods, LLC) to react with 3 moles of diethylenetriamine (Sigma-Aldrich Chemicals, Co.) at 170° C. while collecting the condensate. The amidoamine was neutralized at 70° C. with glacial acetic acid. The final collector composition was 50 wt % of the neutralized product, 37 wt % of water, and 13 wt % of F-663 (BTGE frother from SNF Flomin) Table 3 shows the collector dosage and performance for Ex. 2.

TABLE 3

Ex. 2 (Coconut Oil-DETA Amidoamine)

| Collector Dosage (lb/t) | % $P_2O_5$ Recov. | % $P_2O_5$ Grade | % A.I. Reject | % A.I. Grade | Mass recovery | Separation Efficiency |
|---|---|---|---|---|---|---|
| 1.00 | 97.80 | 27.59 | 2.87 | 18.71 | 97.63 | 0.67 |
| 1.50 | 97.48 | 26.93 | 8.94 | 18.28 | 96.25 | 6.43 |
| 2.00 | 97.27 | 28.63 | 18.14 | 16.46 | 94.32 | 15.42 |
| 2.50 | 96.82 | 29.15 | 30.06 | 13.07 | 92.14 | 26.88 |
| 3.00 | 96.37 | 30.18 | 43.50 | 10.89 | 89.35 | 39.87 |
| 3.50 | 95.78 | 30.47 | 50.96 | 9.71 | 87.57 | 46.75 |

Example 3

A TOFA-DETA amidoamine was produced by allowing 1 mole of tall oil fatty acid (Georgia Pacific Chemicals) to react with 1.3 moles of diethylenetriamine (Sigma-Aldrich Chemicals, Co.) at 170° C. while collecting the condensate. The amidoamine was neutralized at 70° C. with glacial acetic acid. The final collector composition was 50 wt % of the neutralized product, 37 wt % of water, and 13 wt % of F-663. Table 4 shows the collector dosage and performance for Ex.3.

TABLE 4

Ex. 3 (TOFA-DETA Amidoamine)

| Collector Dosage (lb/t) | % $P_2O_5$ Recov. | % $P_2O_5$ Grade | % A.I. Reject | % A.I. Grade | Mass recovery | Separation Efficiency |
|---|---|---|---|---|---|---|
| 1.50 | 98.20 | 28.28 | 2.68 | 18.82 | 97.98 | 0.88 |
| 2.00 | 97.83 | 28.68 | 9.59 | 17.68 | 96.38 | 7.42 |
| 2.50 | 97.81 | 29.04 | 13.91 | 16.94 | 95.53 | 11.71 |
| 3.00 | 97.28 | 29.87 | 29.70 | 14.02 | 92.24 | 26.98 |
| 3.50 | 96.76 | 30.42 | 37.76 | 12.78 | 90.22 | 34.51 |

Example 4

The amine, dodecylamine (Sigma-Aldrich Chemicals, Co.), was neutralized with 37 wt % HCl (Fischer Scientific) based on its amine number. The amine collector composition was 44 wt % of the neutralized product, 48 wt % of water, and 8 wt % of F-663. Table 5 shows the collector dosage and performance for Ex.4.

TABLE 5

Ex. 4 (Dodecylamine)

| Collector Dosage (lb/t) | % $P_2O_5$ Recov. | % $P_2O_5$ Grade | % A.I. Reject | % A.I. Grade | Mass recovery | Separation Efficiency |
|---|---|---|---|---|---|---|
| 1.00 | 97.22 | 28.90 | 14.57 | 16.56 | 94.98 | 11.79 |
| 1.50 | 97.17 | 29.97 | 37.38 | 11.95 | 91.04 | 34.55 |
| 2.00 | 96.13 | 31.29 | 56.25 | 8.81 | 86.80 | 52.38 |
| 2.50 | 95.26 | 31.99 | 69.65 | 6.41 | 83.60 | 64.92 |
| 3.00 | 94.67 | 32.92 | 80.05 | 4.37 | 81.08 | 74.72 |
| 3.50 | 93.63 | 33.45 | 86.66 | 3.01 | 79.02 | 80.29 |

Example 5

The amine, cocoamine (CORSAMINE® PC from CorsiTech), was neutralized with glacial acetic acid with respect to its amine number. The amine collector composition was 87 wt % of the neutralized product and 13 wt % of F-663. Table 6 shows the collector dosage and performance for Ex.5.

TABLE 6

Ex. 5 (Cocoamine)

| Collector Dosage (lb/t) | % $P_2O_5$ Recov. | % $P_2O_5$ Grade | % A.I. Reject | % A.I. Grade | Mass recovery | Separation Efficiency |
|---|---|---|---|---|---|---|
| 1.00 | 96.66 | 30.18 | 52.81 | 9.28 | 88.04 | 49.47 |
| 1.50 | 94.00 | 32.34 | 84.96 | 3.38 | 79.71 | 78.96 |
| 2.00 | 91.84 | 32.21 | 89.41 | 2.47 | 77.11 | 81.25 |
| 2.50 | 89.60 | 31.53 | 90.20 | 2.31 | 75.54 | 79.81 |
| 3.00 | 87.88 | 32.59 | 91.04 | 2.15 | 73.70 | 78.91 |
| 3.50 | 84.12 | 31.96 | 90.94 | 2.24 | 70.91 | 75.06 |

Example 6

A coconut fatty acid-TETA amidoamine was produced by allowing 1 mole of coconut fatty acid (TRC-101, from Twin River Technologies, Inc.) to react with 1.3 moles of triethylenetetraamine (Sigma-Aldrich Chemicals, Co.) at 170° C. while the collecting the condensate. The amidoamine was neutralized at 70° C. with glacial acetic acid. The amidoamine collector composition was 50 wt % of the neutralized product, 37 wt % of water, and 13 wt % of F-663. Table 7 shows the dosage and performance for Ex.6.

TABLE 7

Ex. 6 (Coconut fatty acid-TETA Amidoamine)

| Collector Dosage (lb/t) | % $P_2O_5$ Recov. | % $P_2O_5$ Grade | % A.I. Reject | % A.I. Grade | Mass recovery | Separation Efficiency |
|---|---|---|---|---|---|---|
| 2.00 | 97.46 | 27.84 | 3.29 | 18.59 | 97.27 | 0.76 |

Example 7

A lauric acid-DETA amidoamine was produced by allowing 1 mole of lauric acid (Sigma-Aldrich Chemicals, Co.) to react with 1.3 moles of diethylenetriamine (Sigma-Aldrich Chemicals, Co.) at 170° C. while collecting the condensate. The amidoamine was neutralized at 70° C. with glacial acetic acid. The amidoamine collector composition was 42.5 wt % of the neutralized product, 42.5 wt % of water, and 15 wt % of F-663. Table 8 shows the dosage and performance for Ex.7.

TABLE 8

Ex. 7 (Lauric acid-DETA Amidoamine)

| Collector Dosage (lb/t) | % $P_2O_5$ Recov. | % $P_2O_5$ Grade | % A.I. Reject | % A.I. Grade | Mass recovery | Separation Efficiency |
|---|---|---|---|---|---|---|
| 1.00 | 99.67 | 25.85 | 0.81 | 19.73 | 99.56 | 0.48 |
| 1.50 | 99.13 | 25.66 | 2.12 | 19.49 | 98.86 | 1.25 |
| 2.00 | 99.25 | 25.08 | 3.23 | 22.15 | 98.66 | 2.47 |
| 2.50 | 99.44 | 27.61 | 20.79 | 15.67 | 95.56 | 20.23 |

Example 8

A rosin-TEPA amidoamine was produced by allowing 1.59 moles of rosin acid (LYTOR® 100 from Georgia-Pacific Chemicals) to react with 1.6 moles of tetraethylenepentamine (Sigma-Aldrich Chemicals, Co.) at 170° C. while collecting the condensate. The amidoamine was neutralized at 70° C. with glacial acetic acid. The amidoamine collector composition was 50 wt % of the neutralized product, 37 wt % of water, and 13 wt % of F-663. Table 9 shows the dosage and performance for Ex. 8.

TABLE 9

Ex. 8 (Rosin-TEPA Amidoamine)

| Collector Dosage (lb/t) | % $P_2O_5$ Recov. | % $P_2O_5$ Grade | % A.I. Reject | % A.I. Grade | Mass recovery | Separation Efficiency |
|---|---|---|---|---|---|---|
| 1.00 | 97.83 | 27.29 | 1.06 | 18.94 | 98.02 | −1.11 |
| 1.50 | 97.90 | 27.52 | 1.90 | 19.20 | 97.91 | −0.20 |
| 2.00 | 98.03 | 28.73 | 8.73 | 16.74 | 96.74 | 6.76 |
| 2.50 | 97.45 | 29.36 | 28.38 | 13.88 | 92.67 | 25.83 |
| 3.00 | 96.78 | 30.72 | 44.67 | 11.14 | 89.15 | 41.45 |
| 3.50 | 96.01 | 31.71 | 60.87 | 7.82 | 86.01 | 56.88 |

Example 9

The TOFA-DETA amidoamine of Ex. 3 was mixed with PA-14 of Cl in a 1 to 1 ratio to make a collector composition. Table 10 shows the dosage and performance for Ex. 9.

TABLE 10

| Ex. 9 (TOFA-DETA amidoamine:PA-14 (1:1)) | | | | | | |
|---|---|---|---|---|---|---|
| Collector Dosage (lb/t) | % $P_2O_5$ Recov. | % $P_2O_5$ Grade | % A.I. Reject | % A.I. Grade | Mass recovery | Separation Efficiency |
| 0.50 | 96.53 | 27.82 | 13.03 | 18.31 | 94.57 | 9.56 |
| 1.00 | 96.50 | 30.26 | 44.16 | 10.79 | 89.40 | 40.66 |
| 2.00 | 94.62 | 32.71 | 82.44 | 3.81 | 80.92 | 77.06 |
| 3.00 | 91.93 | 33.18 | 89.91 | 2.34 | 77.07 | 81.84 |

Example 10

The TOFA-DETA amidoamine of Ex. 3 was mixed with PA-14 of Cl in a 3 to 1 ratio to make a collector composition. Table 11 shows the dosage and performance for Ex. 10.

TABLE 11

| Ex. 10 (TOFA-DETA amidoamines:PA-14 (3:1)) | | | | | | |
|---|---|---|---|---|---|---|
| Collector Dosage (lb/t) | % $P_2O_5$ Recov. | % $P_2O_5$ Grade | % A.I. Reject | % A.I. Grade | Mass recovery | Separation Efficiency |
| 0.50 | 96.62 | 27.87 | 10.06 | 17.69 | 95.31 | 6.68 |
| 1.00 | 97.21 | 28.90 | 25.97 | 14.51 | 92.93 | 23.18 |
| 1.50 | 97.12 | 29.81 | 44.08 | 11.39 | 89.52 | 41.20 |
| 2.00 | 96.92 | 31.13 | 59.81 | 8.37 | 86.54 | 56.72 |
| 2.50 | 95.75 | 32.37 | 74.62 | 5.33 | 83.24 | 70.37 |
| 3.00 | 94.78 | 31.96 | 79.87 | 4.45 | 81.33 | 74.65 |
| 3.50 | 94.04 | 32.49 | 85.55 | 3.20 | 79.82 | 79.59 |

Example 11

The TOFA-DETA amidoamine of Ex. 3 was mixed with PA-14 of Cl in a 3 to 2 ratio to make a collector composition. Table 12 shows the dosage and performance for Ex. 11.

TABLE 12

| Ex. 11 (TOFA-DETA amidoamines:PA-14 (3:2)) | | | | | | |
|---|---|---|---|---|---|---|
| Collector Dosage (lb/t) | % $P_2O_5$ Recov. | % $P_2O_5$ Grade | % A.I. Reject | % A.I. Grade | Mass recovery | Separation Efficiency |
| 0.50 | 96.38 | 28.88 | 15.78 | 15.50 | 94.23 | 12.17 |
| 1.00 | 96.48 | 29.49 | 35.96 | 12.97 | 90.49 | 32.45 |
| 2.00 | 94.50 | 32.53 | 80.45 | 4.26 | 81.26 | 74.95 |
| 3.00 | 93.23 | 33.26 | 87.58 | 2.81 | 78.71 | 80.81 |

Example 12

The TOFA-DETA amidoamine of Ex. 3 was mixed with PA-14 of Cl in a 9 to 1 ratio to make a collector composition. Table 13 shows the dosage and performance for Ex. 12.

TABLE 13

| Ex. 12 (TOFA-DETA amidoamines:PA-14 (9:1)) | | | | | | |
|---|---|---|---|---|---|---|
| Collector Dosage (lb/t) | % $P_2O_5$ Recov. | % $P_2O_5$ Grade | % A.I. Reject | % A.I. Grade | Mass recovery | Separation Efficiency |
| 1.00 | 98.18 | 28.40 | 5.40 | 17.40 | 97.48 | 3.58 |
| 1.50 | 97.87 | 28.95 | 15.33 | 14.95 | 95.55 | 13.20 |
| 2.00 | 97.44 | 29.18 | 27.16 | 14.18 | 92.92 | 24.60 |

TABLE 13-continued

| Ex. 12 (TOFA-DETA amidoamines:PA-14 (9:1)) | | | | | | |
|---|---|---|---|---|---|---|
| Collector Dosage (lb/t) | % $P_2O_5$ Recov. | % $P_2O_5$ Grade | % A.I. Reject | % A.I. Grade | Mass recovery | Separation Efficiency |
| 2.50 | 97.04 | 30.84 | 39.25 | 11.72 | 90.54 | 36.29 |
| 3.00 | 96.84 | 30.63 | 48.22 | 10.06 | 88.90 | 45.06 |
| 3.50 | 96.64 | 31.03 | 58.21 | 8.34 | 86.95 | 54.85 |

Example 13

The coconut oil-DETA amidoamine of Ex. 2 was mixed with PA-14 of Cl in a 3 to 1 ratio to make a collector composition. Table 14 shows the dosage and performance for Ex. 13.

TABLE 14

| Ex. 13 (Coconut oil-DETA amidoamines:PA-14 (3:1)) | | | | | | |
|---|---|---|---|---|---|---|
| Collector Dosage (lb/t) | % $P_2O_5$ Recov. | % $P_2O_5$ Grade | % A.I. Reject | % A.I. Grade | Mass recovery | Separation Efficiency |
| 0.50 | 97.59 | 28.22 | 9.72 | 17.16 | 96.18 | 7.31 |
| 1.00 | 97.57 | 28.81 | 29.70 | 14.56 | 92.29 | 27.27 |
| 1.50 | 96.62 | 30.70 | 53.34 | 9.78 | 87.35 | 49.96 |
| 2.00 | 95.85 | 32.92 | 84.45 | 2.99 | 82.88 | 80.30 |
| 2.50 | 94.87 | 32.64 | 79.97 | 4.39 | 81.26 | 74.84 |
| 3.00 | 93.62 | 33.02 | 86.36 | 3.07 | 79.17 | 79.97 |
| 3.50 | 92.13 | 33.21 | 90.21 | 2.27 | 77.14 | 82.34 |

Example 14

The rosin-TEPA amidoamine of Ex. 8 was mixed with dodecylamine of Ex. 4 in a 3 to 1 ratio to make a collector composition. Table 15 shows the dosage and performance for Ex. 14.

TABLE 15

| Ex. 14 (Rosin-TEPA amidoamines:dodecylamine (3:1)) | | | | | | |
|---|---|---|---|---|---|---|
| Collector Dosage (lb/t) | % $P_2O_5$ Recov. | % $P_2O_5$ Grade | % A.I. Reject | % A.I. Grade | Mass recovery | Separation Efficiency |
| 0.50 | 96.83 | 27.79 | 3.86 | 18.50 | 96.61 | 0.69 |
| 1.00 | 97.28 | 27.93 | 2.89 | 17.36 | 97.23 | 0.18 |
| 1.50 | 97.50 | 27.49 | 8.56 | 17.69 | 96.33 | 6.06 |
| 2.00 | 97.30 | 29.11 | 21.64 | 15.82 | 93.61 | 18.94 |
| 2.50 | 96.88 | 28.97 | 28.70 | 14.14 | 92.17 | 25.59 |
| 3.00 | 96.47 | 30.38 | 45.99 | 10.95 | 88.75 | 42.46 |
| 3.50 | 95.46 | 31.91 | 73.23 | 5.67 | 83.16 | 68.68 |

Example 15

The coconut oil-DETA amidoamine of Ex. 2 was mixed with dodecylamine of Ex. 4 in a 3 to 1 ratio to make a collector composition. Table 16 shows the dosage and performance for Ex. 15.

TABLE 16

Ex. 15 (Coconut oil-DETA amidoamines:dodecylamine (3:1))

| Collector Dosage (lb/t) | % $P_2O_5$ Recov. | % $P_2O_5$ Grade | % A.I. Reject | % A.I. Grade | Mass recovery | Separation Efficiency |
|---|---|---|---|---|---|---|
| 1.00 | 97.28 | 28.03 | 6.62 | 17.41 | 96.57 | 3.90 |
| 1.50 | 97.58 | 28.09 | 15.19 | 15.56 | 95.36 | 12.77 |
| 2.00 | 97.09 | 30.01 | 29.85 | 12.94 | 92.39 | 26.93 |
| 2.50 | 96.60 | 30.44 | 42.17 | 11.87 | 89.37 | 38.76 |
| 3.00 | 95.95 | 31.28 | 58.22 | 8.64 | 86.14 | 54.17 |
| 3.50 | 94.36 | 32.16 | 75.56 | 5.26 | 81.84 | 69.92 |

Example 16

The TOFA-DETA amidoamine of Ex. 3 was mixed with cocoamine of Ex. 5 in a 1 to 1 ratio to make a collector composition. Table 16 shows the dosage and performance for Ex. 15.

TABLE 17

Ex. 16 (TOFA-DETA amidoamines:cocoamine (1:1))

| Collector Dosage (lb/t) | % $P_2O_5$ Recov. | % $P_2O_5$ Grade | % A.I. Reject | % A.I. Grade | Mass recovery | Separation Efficiency |
|---|---|---|---|---|---|---|
| 2.00 | 95.95 | 31.95 | 65.97 | 6.97 | 85.04 | 61.92 |

Example 17

The TOFA-DETA amidoamine of Ex. 3 was mixed with the cocoamine of Ex. 5 in a 3 to 1 ratio to make a collector composition. Table 18 shows the dosage and performance for Ex. 17.

TABLE 18

Ex. 17 (TOFA-DETA amidoamines:cocoamine (3:1))

| Collector Dosage (lb/t) | % $P_2O_5$ Recov. | % $P_2O_5$ Grade | % A.I. Reject | % A.I. Grade | Mass recovery | Separation Efficiency |
|---|---|---|---|---|---|---|
| 2.00 | 97.00 | 29.70 | 32.45 | 12.64 | 91.87 | 29.45 |

Example 18

The coconut oil-DETA amidoamine of Ex. 2 was mixed with the cocoamine of Ex. 5 in a 3 to 1 ratio to make a collector composition. Table 19 shows the dosage and performance for Ex. 18.

TABLE 19

Ex. 18 (Coconut oil-DETA amidoamine:cocoamine (3:1))

| Collector Dosage (lb/t) | % $P_2O_5$ Recov. | % $P_2O_5$ Grade | % A.I. Reject | % A.I. Grade | Mass recovery | Separation Efficiency |
|---|---|---|---|---|---|---|
| 2.00 | 96.36 | 30.57 | 49.60 | 10.29 | 88.00 | 45.95 |

Example 19

The coconut fatty acid-TETA amidoamine of Ex. 6 was mixed with the cocoamine of Ex. 5 in a 3 to 1 ratio to make a collector composition. Table 20 shows the dosage and performance for Ex. 19.

TABLE 20

Ex. 19 (Coconut fatty acid-TETA amidoamine:cocoamine (3:1))

| Collector Dosage (lb/t) | % $P_2O_5$ Recov. | % $P_2O_5$ Grade | % A.I. Reject | % A.I. Grade | Mass recovery | Separation Efficiency |
|---|---|---|---|---|---|---|
| 2.00 | 96.85 | 30.25 | 40.98 | 11.85 | 89.92 | 37.84 |

Example 20

The rosin-TEPA amidoamine of Ex. 8 was mixed with the TOFA-DETA amidoamine of Ex. 3 and the dodecylamine of Ex. 4 in a 1 to 1 to 1 ratio to make a collector composition. Table 21 shows the dosage and performance for Ex. 20.

TABLE 21

Ex. 20 (Rosin-TEPA amidoamines:TOFA-DETA amidoamine:dodecylamine (1:1:1))

| Collector Dosage (lb/t) | % $P_2O_5$ Recov. | % $P_2O_5$ Grade | % A.I. Reject | % A.I. Grade | Mass recovery | Separation Efficiency |
|---|---|---|---|---|---|---|
| 1.00 | 97.52 | 28.04 | 6.01 | 16.29 | 96.91 | 3.53 |
| 1.50 | 97.41 | 28.44 | 12.57 | 16.36 | 95.58 | 9.99 |
| 2.00 | 97.34 | 29.71 | 27.25 | 14.21 | 92.73 | 24.59 |
| 2.50 | 97.27 | 29.51 | 27.19 | 13.71 | 92.89 | 24.46 |
| 3.00 | 95.82 | 31.46 | 66.13 | 6.89 | 84.94 | 61.94 |
| 3.50 | 95.22 | 31.87 | 71.80 | 5.90 | 83.36 | 67.02 |

Example 21

The rosin-TEPA amidoamine of Ex. 8 was mixed with the TOFA-DETA amidoamine of Ex. 3 and the TOMAMINE® PA-14 of Cl in a 1 to 1 ratio to make a collector composition. Table 22 shows the dosage and performance for Ex. 21.

TABLE 22

Ex. 21 (Rosin-TEPA amidoamine/PA-14 (1:1))

| Collector Dosage (lb/t) | % $P_2O_5$ Recov. | % $P_2O_5$ Grade | % A.I. Reject | % A.I. Grade | Mass recovery | Separation Efficiency |
|---|---|---|---|---|---|---|
| 1.00 | 97.23 | 29.59 | 29.81 | 13.33 | 92.44 | 27.04 |
| 1.50 | 96.58 | 31.05 | 52.75 | 9.35 | 87.87 | 49.33 |
| 2.00 | 95.20 | 32.19 | 76.19 | 4.91 | 82.94 | 71.39 |
| 2.50 | 94.32 | 32.80 | 82.20 | 3.92 | 80.48 | 76.53 |
| 3.00 | 93.43 | 33.41 | 87.49 | 2.81 | 78.89 | 80.92 |
| 3.50 | 93.02 | 33.51 | 88.65 | 2.60 | 78.18 | 81.68 |

Example 22

The coconut fatty acid-DETA amidoamine of Ex. 1 was mixed with the dodecylamine of Ex. 4 in a 1 to 1 ratio to make a collector composition. Table 23 shows the dosage and performance for Ex. 22.

TABLE 23

| Ex. 22 (Coconut fatty acid-DETA amidoamine:dodecylamine (3:1)) | | | | | | |
|---|---|---|---|---|---|---|
| Collector Dosage (lb/t) | % $P_2O_5$ Recov. | % $P_2O_5$ Grade | % A.I. Reject | % A.I. Grade | Mass recovery | Separation Efficiency |
| 0.50 | 99.33 | 26.06 | 1.27 | 18.05 | 99.12 | 0.60 |
| 1.00 | 99.02 | 26.70 | 14.10 | 16.38 | 96.47 | 13.12 |
| 1.50 | 98.81 | 28.07 | 37.29 | 13.29 | 91.57 | 36.10 |
| 2.00 | 98.44 | 29.06 | 53.67 | 10.06 | 88.17 | 52.10 |

Example 23

The coconut fatty acid-DETA amidoamine of Ex. 1 was mixed with the TOMAMINE® PA-14 of Cl in a 1 to 1 ratio to make a collector composition. Table 22 shows the dosage and performance for Ex. 21.

TABLE 24

| Ex. 23 (Coconut fatty acid-DETA amidoamine:PA-14 (3:1)) | | | | | | |
|---|---|---|---|---|---|---|
| Collector Dosage (lb/t) | % $P_2O_5$ Recov. | % $P_2O_5$ Grade | % A.I. Reject | % A.I. Grade | Mass recovery | Separation Efficiency |
| 0.50 | 98.74 | 26.51 | 17.69 | 17.37 | 95.29 | 16.43 |
| 1.00 | 97.83 | 29.35 | 67.75 | 7.63 | 84.64 | 65.58 |
| 1.50 | 97.78 | 30.25 | 72.64 | 6.35 | 83.93 | 70.42 |
| 2.00 | 97.17 | 30.58 | 75.85 | 5.57 | 82.99 | 73.02 |

Embodiments of the present disclosure further relate to any one or more of the following paragraphs:

1. A collector composition, comprising one or more amidoamines and one or more amines, wherein the one or more amidoamines has a formula:

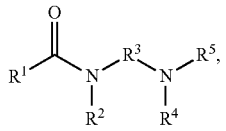

wherein:

$R^1$ is a ($C_1$-$C_{24}$)alkyl, a ($C_1$-$C_{24}$)alkenyl, a ($C_1$-$C_{24}$) dialkenyl, a ($C_1$-$C_{24}$)cycloalkyl, a ($C_1$-$C_{24}$)cylcoalkenyl, a ($C_1$-$C_{24}$)cyclodialkenyl, a phenyl, a benzyl, an unsubstituted aryl, or an aryl substituted by one or more substituents selected from a halogen, a ($C_1$-$C_6$)alkyl, and a halogen-($C_1$-$C_6$) alkyl;

$R^2$ is a hydrogen, a ($C_1$-$C_6$)alkyl, a halogen-($C_1$-$C_6$) alkyl, a ($C_1$-$C_6$)alkenyl, a heterocyclyl, an unsubstituted aryl, or an aryl substituted by one or more substituents selected from a halogen, a ($C_1$-$C_6$) alkyl, and a halogen-($C_1$-$C_6$)alkyl;

$R^3$ is a ($C_1$-$C_{24}$)alkylene, a ($C_1$-$C_{24}$)alkenylene, a ($C_1$-$C_{24}$)dialkenylene, a ($C_1$-$C_{24}$)cycloalkylene, a ($C_1$-$C_{24}$)cylcoalkenylene, or a ($C_1$-$C_{24}$)cyclodialkenylene; and $R^4$ and $R^5$ are independently selected from a hydrogen, a ($C_1$-$C_{24}$)alkyl, a ($C_1$-$C_{24}$)alkenyl, a ($C_1$-$C_{24}$)dialkenyl, a ($C_1$-$C_{24}$)cycloalkyl, a ($C_1$-$C_{24}$) cylcoalkenyl, and a ($C_1$-$C_{24}$)cyclodialkenyl;

wherein the one or more amines has a formula:

$R^6$—$NH_2$, wherein $R^6$ is a ($C_1$-$C_{24}$)alkyl, a phenyl, a benzyl, a ($C_1$-$C_{24}$)alkenyl, a heterocyclyl, an unsubstituted aryl, or an aryl substituted by one or more ($C_1$-$C_8$) alkyl substituents; and wherein a weight ratio of the amidoamine to the amine is about 99:1 to about 1:99.

2. The composition according to paragraph 1, wherein the amidoamine is produced by reacting tall oil fatty acids and one or more polyamines.

3. The composition according to any one of paragraphs 1 or 2, wherein the polyamine is diethylenetriamine.

4. The composition according to any one of paragraphs 1 to 3, wherein the polyamine is 1,3-diaminopentane.

5. The composition according to any one of paragraphs 1 to 4, wherein the amidoamine is produced by reacting coconut oil and one or more polyamines.

6. The composition according to any one of paragraphs 1 to 5, wherein a weight ratio of the amidoamine to the amine is about 1:3 to about 3:1.

7. A method for froth flotation, comprising:

contacting an aqueous slurry comprising a crude material with a collector composition comprising an amidoamine and an amine to provide a treated mixture, wherein the crude material comprises one or more purifiable materials, and wherein the amidoamine has a formula, and wherein the amidoamine has a formula:

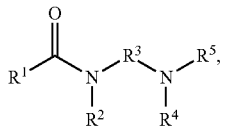

wherein:

$R^1$ is a ($C_1$-$C_{24}$)alkyl, a ($C_1$-$C_{24}$)alkenyl, a ($C_1$-$C_{24}$) dialkenyl, a ($C_1$-$C_{24}$)cycloalkyl, a ($C_1$-$C_{24}$)cylcoalkenyl, a ($C_1$-$C_{24}$)cyclodialkenyl, a phenyl, a benzyl, an unsubstituted aryl, or an aryl substituted by one or more substituents selected from a halogen, a ($C_1$-$C_6$)alkyl, and a halogen-($C_1$-$C_6$) alkyl;

$R^2$ is a hydrogen, a ($C_1$-$C_6$)alkyl, a halogen-($C_1$-$C_6$) alkyl, a ($C_1$-$C_6$)alkenyl, a heterocyclyl, an unsubstituted aryl, or an aryl substituted by one or more substituents selected from a halogen, a ($C_1$-$C_6$) alkyl, and a halogen-($C_1$-$C_6$)alkyl;

$R^3$ is a ($C_1$-$C_{24}$)alkylene, a ($C_1$-$C_{24}$)alkenylene, a ($C_1$-$C_{24}$)dialkenylene, a ($C_1$-$C_{24}$)cycloalkylene, a ($C_1$-$C_{24}$)cylcoalkenylene, or a ($C_1$-$C_{24}$)cyclodialkenylene; and $R^4$ and $R^5$ are independently selected from a hydrogen, a ($C_1$-$C_{24}$)alkyl, a ($C_1$-$C_{24}$)alkenyl, a ($C_1$-$C_{24}$)dialkenyl, a ($C_1$-$C_{24}$)cycloalkyl, a ($C_1$-$C_{24}$) cylcoalkenyl, and a ($C_1$-$C_{24}$)cyclodialkenyl;

wherein the amine has a formula:

$R^6$—$NH_2$, wherein $R^6$ is a ($C_1$-$C_{24}$)alkyl, a phenyl, a benzyl, a ($C_1$-$C_{24}$)alkenyl, a heterocyclyl, an unsubstituted aryl, or an aryl substituted by one or more ($C_1$-$C_8$)alkyl substituents; and wherein a weight ratio of the amidoamine to the amine is about 99:1 to about 1:99; and collecting the one or more purifiable materials from the treated mixture.

8. The method according to paragraph 7, wherein the amidoamine is produced by reacting tall oil fatty acids and one or more polyamines.

9. The method according to any one of paragraphs 7 or 8, wherein the polyamine comprises diethylenetriamine.

10. The method according to any one of paragraphs 7 to 9, wherein the polyamine comprises 1,3-diaminopentane.

11. The method according to any one of paragraphs 7 to 10, wherein the amidoamine is produced by reacting coconut oil and one or more polyamines.

12. The method according to any one of paragraphs 7 to 11, wherein a weight ratio of the amidoamine to the amine is about 1:3 to about 3:1.

13. The method according to any one of paragraphs 7 to 12, wherein the one or more purifiable materials comprise iron, one or more iron oxides, or any mixture thereof.

14. The method according to any one of paragraphs 7 to 13, wherein the one or more purifiable materials comprise phosphorus, one or more phosphorus oxides, or any mixture thereof.

15. The method according to any one of paragraphs 7 to 14, wherein the one or more contaminants comprise silica.

16. The method according to any one of paragraphs 7 to 15, wherein the collector composition further comprises:

one or more ether diamines of a formula:

$$R^9—O—R^{10}NH—R^{11}—NH_2,$$

wherein:

$R^9$ is hydrogen, a $(C_1-C_{18})$alkyl, a halogen-$(C_1-C_{18})$alkyl, a phenyl, a $(C_1-C_{18})$alkenyl, a heterocyclyl, an unsubstituted aryl, or an aryl substituted by one or more substituents selected from a halogen, a $(C_1-C_{18})$alkyl, and a halogen-$(C_1-C_{18})$alkyls; and $R^{10}$ and $R^{11}$ are independently selected from a $(C_1-C_6)$alkylene, a halogen-$(C_1-C_6)$alkylene, a phenylene, a $(C_1-C_6)$alkenylene, a heterocyclylene, an unsubstituted arylene, or an arylene substituted by one or more substituents selected from a halogen, a $(C_1-C_6)$alkyl, and a halogen-$(C_1-C_6)$alkyl;

wherein the weight ratio of the amidoamine to the amine is about 98:1 to about 1:98; and wherein a weight ratio of the amidoamine to the ether diamine is about 98:1 to about 1:98.

17. The method according to any one of paragraphs 7 to 16, wherein the weight ratio of the amidoamine to the amine is about 3:1 to about 1:3, and wherein the weight ratio of the amidoamine to the etheramine is about 3:1 to about 1:3.

18. The method according to any one of paragraphs 7 to 17, wherein the one or more purifiable materials comprise iron, one or more iron oxides, or any mixture thereof.

19. The method according to any one of paragraphs 7 to 18, wherein the one or more purifiable materials comprise phosphorus, one or more phosphorus oxides, or any mixture thereof.

20. The method according to any one of paragraphs 7 to 19, wherein the one or more contaminants comprise silica.

21. The method according to any one of paragraphs 7 to 20, wherein the collector composition further comprises:

one or more etheramines of a formula:

$$R^7—O—R^8—NH_2,$$

wherein:

$R^7$ is hydrogen, a $(C_1-C_{18})$alkyl, a halogen-$(C_1-C_{18})$alkyl, a phenyl, a $(C_1-C_6)$alkenyl, a heterocyclyl, an unsubstituted aryl or an aryl substituted by one or more substituents selected from a halogen, a $(C_1-C_{18})$alkyl, and a halogen-$(C_1-C_{18})$alkyl; and $R^8$ is selected from a $(C_1-C_6)$alkylene, a halogen-$(C_1-C_6)$alkylene, a phenylene, a $(C_1-C_6)$alkenylene, a heterocyclylene, an unsubstituted arylene or an arylene substituted by one or more substituents selected from a halogen, a $(C_1-C_6)$alkyl, and a halogen-$(C_1-C_6)$alkyl;

wherein the weight ratio of the amidoamine to the amine is about 98:1 to about 1:98; and wherein the weight ratio of the amidoamine to the etheramine is about 98:1 to about 1:98.

22. The method according to any one of paragraphs 7 to 21, wherein the weight ratio of the amidoamine to the amine is about 1:1 to about 3:1, and wherein the weight ratio of the amidoamine to the etheramine is about 1:1 to about 3:1.

23. The method according to any one of paragraphs 7 to 22, wherein the one or more purifiable materials comprise iron, one or more iron oxides, or any mixture thereof.

24. The method according to any one of paragraphs 7 to 23, wherein the one or more purifiable materials comprise phosphorus, one or more phosphorus oxides, or any mixture thereof.

25. The method according to any one of paragraphs 7 to 24, wherein the one or more contaminants comprise silica.

26. A method for froth flotation comprising:

contacting an aqueous slurry comprising a crude material with a collector composition comprising an amidoamine and an amine to provide a treated mixture, wherein the crude material comprises one or more purifiable materials, and wherein the collector composition comprises:

one or more amidoamines of a formula:

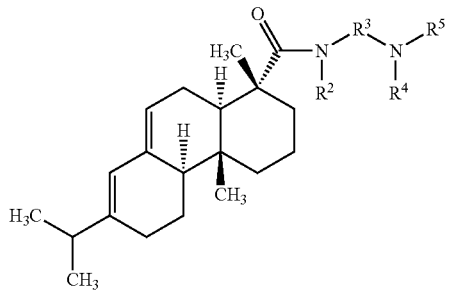

or a formula:

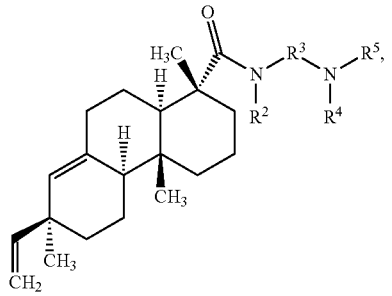

wherein:

$R^2$ is a hydrogen, a $(C_1-C_6)$alkyl, a halogen-$(C_1-C_6)$alkyl, a $(C_1-C_6)$alkenyl, a heterocyclyl, an unsubstituted aryl, or an aryl substituted by one or more substituents selected from a halogen, a $(C_1-C_6)$alkyl, and a halogen-$(C_1-C_6)$alkyl;

$R^3$ is a $(C_1-C_{24})$alkylene, a $(C_1-C_{24})$alkenylene, a $(C_1-C_{24})$dialkenylene, a $(C_1-C_{24})$cycloalkylene, a $(C_1-C_{24})$cylcoalkenylene, or a $(C_1-C_{24})$cyclodialkenylene; and $R^4$ and $R^5$ are independently selected from a hydrogen, a $(C_1-C_{24})$alkyl, a $(C_1-C_{24})$alkenyl, a $(C_1-C_{24})$dialkenyl, a $(C_1-C_{24})$cycloalkyl, a $(C_1-C_{24})$cylcoalkenyl, and a $(C_1-C_{24})$cyclodialkenyl; and one or more amines of a formula:

$R^6—NH_2$, wherein $R^6$ is a $(C_1-C_{24})$alkyl, a phenyl, a benzyl, a $(C_1-C_{24})$alkenyl, a heterocyclyl, an unsubstituted aryl, or an aryl substituted by one or more $(C_1-C_8)$alkyl substituents; and wherein a weight ratio of the amidoamine to the amine is about 99:1 to about 1:99, and collecting the one or more purifiable materials from the treated mixture.

27. The method according to paragraphs 26, wherein the amidoamine is produced by reacting tall oil rosins and one or more polyamines.

28. The method according to any one of paragraphs 26 or 27, wherein a weight ratio of the amidoamine to the amine is about 1:3 to about 3:1.

29. The method according to any one of paragraphs 26 or 28, wherein the polyamine comprises diethylenetriamine.

30. The method according to any one of paragraphs 26 or 29, wherein the polyamine comprises 1,3-diaminopentane.

31. The method according to any one of paragraphs 26 or 30, wherein the one or more purifiable materials comprise iron, one or more iron oxides, or any mixture thereof.

32. The method according to any one of paragraphs 26 or 31, wherein the one or more purifiable materials comprise phosphorus, one or more phosphorus oxides, or any mixture thereof.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A collector composition, comprising an amidoamine and an amine, wherein:

a weight ratio of the amidoamine to the amine is about 99:1 to about 1:99, the amidoamine is produced by reacting tall oil fatty acids and a polyamine comprising 1,3-diaminopentane, and the amine has a formula:

$R^6—NH_2$, wherein $R^6$ is a $(C_1-C_{24})$alkyl, a phenyl, a benzyl, a $(C_1-C_{24})$alkenyl, a heterocyclyl, an unsubstituted aryl, or an aryl substituted by one or more $(C_1-C_8)$alkyl substituents.

2. The composition of claim 1, wherein the weight ratio of the amidoamine to the amine is about 1:3 to about 3:1.

3. The composition of claim 1, wherein the polyamine further comprises diethylenetriamine; N-(hydroxyethyl)ethylenediamine; 3-(dimethylamino)-1-propylamine; aminoguanidine bicarbonate; 1,5-diamino-2-methylpentane; 1,2-diaminopropane; 2,4-diaminotoluene; 2,4-diaminobenzene sulfonic acid; N,N-dimethylaminopropyl-N-proplyenediamine; 3-(N,N-diethylamino)propylamine, 2-amino-4-methylpyridine; 2-(N,N-diethylamino)ethylamine; 2-amino-6-methylpyridine; 2-aminothiazole; aminoguanidine carbonate; aminoethylpiperazine; 1-methylpiperazine; 2-aminopyrimidine; aminoethylaminopropyltrimethoxysilane; 2-aminopyridine; 5-aminotetrazole; 2-amino-3-methylpyridine; 2-aminobenzothiazole; 3-aminomethylpyridine; 3-picolylamine; 3-morpholinopropylamine; 1-ethylpiperazine; N-methylpropylenediamine, histidine; aminoethylaminoethylaminopropyltrimethoxysilane; 3-aminopyridine; N-ethylethylenediamine; aminopropylimidazole; 2-methylpiperazine; 2-amino-5-diethylaminopentane; 3-amino-1,2,4-triazole; 2-(N,N-dimethylamino)ethylamine; L-ornithine-monohydrochloride; N-(aminoethyl)morpholine; 6-aminopurine; histamine; 1-[2-[[2-[(2-aminoethyl)amino]ethyl]amino]ethyl]-piperazine); N-[(2-aminoethyl)2-aminoethyl]piperazine)]; 5,6-diamino-2-thiouracil; adenosine; adenosine 3',5'-cyclic monophosphate; S-adenosylmethionine, S-adenosyl homocysteine; 5-hydroxylysine; carnosine; serotonin; 5-hydroxytryptophan; N-methyltryptamine; norbaeocystin; 5, 6-dibromotryptamine; 6-bromotryptamine; anserine; beta-methylamino-L-alanine, diphthamide; ibotenic acid; saccharopine; 4-aminopiperidine; 3-aminopiperidine; 2,4-diaminobenzoic acid; 1,2-diaminoanthraquinone; 2,3-diaminophenol; 2,4-diaminophenol; 2,3-diaminopropionic acid; 1-amino-4-methylpiperidine; 4-(aminomethyl)piperidine; 4-amino-2,2,6,6-tetramethylpiperidine; 3-aminopyrrolidine; 4-aminobenzylamine; 2-aminobenzylamine; or any mixture thereof.

4. The composition of claim 1, wherein the polyamine further comprises diethylenetriamine.

5. The composition of claim 1, wherein the collector composition further comprises:

one or more etheramines having a formula:

$R^7—O—R^8—NH_2$, wherein:

$R^7$ is hydrogen, a $(C_1-C_{18})$alkyl, a halogen-$(C_1-C_{18})$alkyl, a phenyl, a $(C_1-C_6)$alkenyl, a heterocyclyl, an unsubstituted aryl, or an aryl substituted by one or more substituents selected from a halogen, a $(C_1-C_{18})$alkyl, and a halogen-$(C_1-C_{18})$alkyl; and $R^8$ is selected from a $(C_1-C_6)$alkylene, a halogen-$(C_1-C_6)$alkylene, a phenylene, a $(C_1-C_6)$alkenylene, a heterocyclylene, an unsubstituted arylene, or an arylene substituted by one or more substituents selected from a halogen, a $(C_1-C_6)$alkyl, and a halogen-$(C_1-C_6)$alkyl;

wherein the weight ratio of the amidoamine to the amine is about 98:1 to about 1:98; and wherein a weight ratio of the amidoamine to the ether-amine is about 98:1 to about 1:98.

6. The composition of claim 1, wherein the collector composition further comprises:

one or more ether diamines having a formula:

$R^9—O—R^{10}—NH—R^{11}—NH_2$, wherein:

$R^9$ is hydrogen, a $(C_1-C_{18})$alkyl, a halogen-$(C_1-C_{18})$alkyl, a phenyl, a $(C_1-C_{18})$alkenyl, a heterocyclyl, an unsubstituted aryl, or an aryl substituted by one or more substituents selected from a halogen, a $(C_1-C_{18})$alkyl, and a halogen-$(C_1-C_{18})$alkyls; and $R^{10}$ and $R^{11}$ are independently selected from a $(C_1-C_6)$alkylene, a halogen-$(C_1-C_6)$alkylene, a phenylene, a $(C_1-C_6)$alkenylene, a heterocyclylene, an unsubstituted arylene, or an arylene substituted by one or more substituents selected from a halogen, a $(C_1-C_6)$alkyl, and a halogen-$(C_1-C_6)$alkyl;

wherein a weight ratio of the amidoamine to the amine is about 98:1 to about 1:98; and wherein a weight ratio of the amidoamine to the ether-amine is about 98:1 to about 1:98.

7. A collector composition, comprising an amidoamine and an amine, wherein:

a weight ratio of the amidoamine to the amine is about 99:1 to about 1:99, the amidoamine is produced by reacting coconut oil and a polyamine comprising 1,3-diaminopentane, and the amine has a formula:

$R^6—NH_2$, wherein $R^6$ is a $(C_1-C_{24})$alkyl, a phenyl, a benzyl, a $(C_1-C_{24})$alkenyl, a heterocyclyl, an unsubstituted aryl, or an aryl substituted by one or more $(C_1-C_8)$alkyl substituents.

8. The composition of claim 7, wherein the polyamine further comprises diethylenetriamine; N-(hydroxyethyl)ethylenediamine; 3-(dimethylamino)-1-propylamine; aminoguanidine bicarbonate; 1,5-diamino-2-methylpentane; 1,2-diaminopropane; 2,4-diaminotoluene; 2,4-diaminobenzene sulfonic acid; N,N-dimethylaminopropyl-N-proplyenediamine; 3-(N,N-diethylamino)propylamine, 2-amino-4-methylpyridine; 2-(N,N-diethylamino)ethylamine; 2-amino-6-methylpyridine; 2-aminothiazole; aminoguanidine carbonate; aminoethylpiperazine; 1-methylpiperazine; 2-aminopyrimidine; aminoethylaminopropyltrimethoxysilane; 2-aminopyridine; 5-aminotetrazole; 2-amino-3-methylpyridine; 2-aminobenzothiazole; 3-aminomethylpyridine; 3-picolylamine; 3-morpholinopropylamine; 1-ethylpiperazine; N-methylpropylenediamine, histidine; aminoethylaminoethylaminopropyltrimethoxysilane; 3-aminopyridine; N-ethylethylenediamine; aminopropylimidazole; 2-methylpiperazine; 2-amino-5-diethylaminopentane; 3-amino-1,2,4-triazole; 2-(N,N-dimethylamino)ethylamine; L-ornithine-monohydrochloride; N-(aminoethyl)morpholine; 6-aminopurine; histamine; 1-[2-[[2-[(2-aminoethyl)amino]ethyl]amino]ethyl]-piperazine); N-[(2-aminoethyl)2-aminoethyl]piperazine)]; 5,6-diamino-2-thiouracil; adenosine; adenosine 3',5'-cyclic monophosphate; S-adenosylmethionine, S-adenosyl homocysteine; 5-hydroxylysine; carnosine; serotonin; 5-hydroxytryptophan; N-methyltryptamine; norbaeocystin; 5, 6-dibromotryptamine; 6-bromotryptamine; anserine; beta-methylamino-L-alanine, diphthamide; ibotenic acid; saccharopine; 4-aminopiperidine; 3-aminopiperidine; 2,4-diaminobenzoic acid; 1,2-diaminoanthraquinone; 2,3-diaminophenol; 2,4-diaminophenol; 2,3-diaminopropionic acid; 1-amino-4-methylpiperidine; 4-(aminomethyl)piperidine; 4-amino-2,2,6,6-tetramethylpiperidine; 3-aminopyrrolidine; 4-aminobenzylamine; 2-aminobenzylamine; or any mixture thereof.

9. The composition of claim 7, wherein the polyamine further comprises diethylenetriamine.

10. The composition of claim 7, wherein the collector composition further comprises:

one or more etheramines having a formula:

$R^7—O—R^8—NH_2$, wherein:

$R^7$ is hydrogen, a $(C_1-C_{18})$alkyl, a halogen-$(C_1-C_{18})$alkyl, a phenyl, a $(C_1-C_6)$alkenyl, a heterocyclyl, an unsubstituted aryl, or an aryl substituted by one or more substituents selected from a halogen, a $(C_1-C_{18})$alkyl, and a halogen-$(C_1-C_{18})$alkyl; and $R^8$ is selected from a $(C_1-C_6)$alkylene, a halogen-$(C_1-C_6)$alkylene, a phenylene, a $(C_1-C_6)$alkenylene, a heterocyclylene, an unsubstituted arylene, or an arylene substituted by one or more substituents selected from a halogen, a $(C_1-C_6)$alkyl, and a halogen-$(C_1-C_6)$alkyl;

wherein the weight ratio of the amidoamine to the amine is about 98:1 to about 1:98; and wherein a weight ratio of the amidoamine to the ether-amine is about 98:1 to about 1:98.

11. The composition of claim 7, wherein the collector composition further comprises:

one or more ether diamines having a formula:

$R^9—O—R^{10}—NH—R^{11}—NH_2$, wherein:

$R^9$ is hydrogen, a $(C_1-C_{18})$alkyl, a halogen-$(C_1-C_{18})$alkyl, a phenyl, a $(C_1-C_{18})$alkenyl, a heterocyclyl, an unsubstituted aryl, or an aryl substituted by one or more substituents selected from a halogen, a $(C_1-C_{18})$alkyl, and a halogen-$(C_1-C_{18})$alkyls; and $R^{10}$ and $R^{11}$ are independently selected from a $(C_1-C_6)$alkylene, a halogen-$(C_1-C_6)$alkylene, a phenylene, a $(C_1-C_6)$alkenylene, a heterocyclylene, an unsubstituted arylene, or an arylene substituted by one or more substituents selected from a halogen, a $(C_1-C_6)$alkyl, and a halogen-$(C_1-C_6)$alkyl;

wherein a weight ratio of the amidoamine to the amine is about 98:1 to about 1:98; and wherein a weight ratio of the amidoamine to the ether-amine is about 98:1 to about 1:98.

12. A method for froth flotation, comprising:

contacting an aqueous slurry comprising a crude material with a collector composition comprising an amidoamine and an amine to provide a treated mixture, wherein:

the crude material comprises a siliceous contaminant, a weight ratio of the amidoamine to the amine is about 99:1 to about 1:99, the amidoamine is produced by reacting tall oil fatty acids and a polyamine comprising 1,3-diaminopentane, and the amine has a formula:

$R^6—NH_2$, wherein $R^6$ is a $(C_1-C_{24})$alkyl, a phenyl, a benzyl, a $(C_1-C_{24})$alkenyl, a heterocyclyl, an unsubstituted aryl, or an aryl substituted by one or more $(C_1-C_8)$alkyl substituents; and collecting a purified product from the treated mixture.

13. The method of claim 12, wherein the purified product comprises iron, one or more iron oxides, or any mixture thereof.

14. The method of claim 12, wherein the siliceous contaminant comprises sand, clay, ash, or any mixture thereof.

15. The method of claim 12, wherein the purified product comprises phosphorus, one or more phosphorus oxides, or any mixture thereof.

16. The method of claim 12, wherein the collector composition further comprises:

one or more ether diamines having a formula:

$$R^9—O—R^{10}—NH—R^{11}—NH_2,$$

wherein:

$R^9$ is hydrogen, a $(C_1-C_{18})$alkyl, a halogen-$(C_1-C_{18})$alkyl, a phenyl, a $(C_1-C_{18})$alkenyl, a heterocyclyl, an unsubstituted aryl, or an aryl substituted by one or more substituents selected from a halogen, a $(C_1-C_{18})$alkyl, and a halogen-$(C_1-C_{18})$alkyls; and $R^{10}$ and $R^{11}$ are independently selected from a $(C_1-C_6)$alkylene, a halogen-$(C_1-C_6)$alkylene, a phenylene, a $(C_1-C_6)$alkenylene, a heterocyclylene, an unsubstituted arylene, or an arylene substituted by one or more substituents selected from a halogen, a $(C_1-C_6)$alkyl, and a halogen-$(C_1-C_6)$alkyl;

wherein a weight ratio of the amidoamine to the amine is about 98:1 to about 1:98; and wherein a weight ratio of the amidoamine to the etheramine is about 98:1 to about 1:98.

17. The method of claim 16, wherein the purified product comprises iron, one or more iron oxides, or a mixture thereof.

18. The method of claim 16, wherein the purified product comprises phosphorus, one or more phosphorus oxides, or a mixture thereof.

19. The method of claim 12, wherein the collector composition further comprises:

one or more etheramines having a formula:

$$R^7—O—R^8—NH_2,$$

wherein:

$R^7$ is hydrogen, a $(C_1-C_{18})$alkyl, a halogen-$(C_1-C_{18})$alkyl, a phenyl, a $(C_1-C_6)$alkenyl, a heterocyclyl, an unsubstituted aryl, or an aryl substituted by one or more substituents selected from a halogen, a $(C_1-C_{18})$alkyl, and a halogen-$(C_1-C_{18})$alkyl; and $R^8$ is selected from a $(C_1-C_6)$alkylene, a halogen-$(C_1-C_6)$alkylene, a phenylene, a $(C_1-C_6)$alkenylene, a heterocyclylene, an unsubstituted arylene, or an arylene substituted by one or more substituents selected from a halogen, a $(C_1-C_6)$alkyl, and a halogen-$(C_1-C_6)$alkyl;

wherein the weight ratio of the amidoamine to the amine is about 98:1 to about 1:98; and wherein a weight ratio of the amidoamine to the etheramine is about 98:1 to about 1:98.

20. The method of claim 19, wherein the purified product comprises iron, one or more iron oxides, or any mixture thereof.

21. The method of claim 19, wherein the purified product comprises phosphorus, one or more phosphorus oxides, or any mixture thereof.

* * * * *